US006873313B2

(12) United States Patent
Washio et al.

(10) Patent No.: US 6,873,313 B2
(45) Date of Patent: Mar. 29, 2005

(54) IMAGE DISPLAY DEVICE AND DRIVING METHOD THEREOF

(75) Inventors: Hajime Washio, Tenri (JP); Nobuhiro Kuwabara, Tenri (JP); Hiroshi Yoneda, Ikoma (JP); Shigeto Yoshida, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 533 days.

(21) Appl. No.: 09/822,768

(22) Filed: Mar. 30, 2001

(65) Prior Publication Data

US 2001/0033261 A1 Oct. 25, 2001

Related U.S. Application Data

(63) Continuation-in-part of application No. 09/694,112, filed on Oct. 20, 2000.

(30) Foreign Application Priority Data

| | | |
|---|---|---|
| Oct. 22, 1999 | (JP) | 11-300415 |
| Mar. 30, 2000 | (JP) | 2000-093480 |
| Jun. 27, 2000 | (JP) | 2000-192210 |
| Feb. 15, 2001 | (JP) | 2001-038377 |

(51) Int. Cl.[7] ..... G09G 3/36

(52) U.S. Cl. ..... 345/100; 345/55; 345/77; 345/78; 345/82; 345/85; 345/98; 345/99; 315/167; 315/168; 315/169.1; 315/169.2; 315/169.3; 349/139; 349/143; 349/149

(58) Field of Search ..... 345/55, 85, 89, 345/169.1, 169.2, 169.3, 167, 168, 100, 98, 99, 77, 78, 82; 349/139, 143, 149

(56) References Cited

U.S. PATENT DOCUMENTS

| | | | | | |
|---|---|---|---|---|---|
| 5,223,824 | A | * | 6/1993 | Takeda et al. | 345/93 |
| 5,243,202 | A | * | 9/1993 | Mori et al. | 257/59 |
| 5,625,376 | A | | 4/1997 | Maekawa | |
| 6,084,562 | A | * | 7/2000 | Onda | 345/94 |
| 6,191,769 | B1 | * | 2/2001 | Fujiwara et al. | 345/99 |
| 6,232,945 | B1 | * | 5/2001 | Moriyama et al. | 345/98 |
| 6,281,826 | B1 | * | 8/2001 | Kimura | 341/150 |
| 6,369,786 | B1 | * | 4/2002 | Suzuki | 345/77 |
| 6,531,996 | B1 | * | 3/2003 | Murade | 345/98 |

FOREIGN PATENT DOCUMENTS

| | | |
|---|---|---|
| JP | 07-295521 | 11/1995 |
| JP | 10-187100 | 7/1998 |

* cited by examiner

*Primary Examiner*—Xiao Wu
*Assistant Examiner*—Abbas Abdulselam
(74) *Attorney, Agent, or Firm*—David G. Conlin; William J. Daley, Jr.; Edwards & Angell, LLP

(57) ABSTRACT

An image display device of this invention includes a pre-charging voltage stabilizing section having current controlling means and charge holding means which respectively include a resistor and a capacitor to stabilize a pre-charging voltage. The charge holding means holds a voltage to be supplied to data signal lines, and the current controlling means suppresses a current flow from a control signal generating circuit, thereby suppressing power fluctuation at the control signal generating circuit. This suppresses fluctuation in the pre-charging voltage and enables data signal lines to be charged to a predetermined voltage, thereby suppressing deterioration of image quality and an increase in power consumption of the image display device. Further, when using the pre-charging voltage stabilizing section and setting a portion of a display as a video data non-display area avoiding display of video data in a non-match image display mode to display at fixed brightness in the video data non-display area by a pre-charging voltage from a pre-charging circuit, a control signal is suspended in a fixed period, thus realizing a non-match image display mode to display a video image of an aspect ratio different from that of a screen of a display without impairing an image quality, and saving power.

48 Claims, 24 Drawing Sheets

IMAGE DISPLAY DEVICE AND DRIVING METHOD THEREOF

This application is a continuation-in-part of co-pending U.S. application Ser. No. 09/694,112, filed Oct. 20, 2000, the teachings of which are incorporated herein by reference.

FIELD OF THE INVENTION

The present invention relates to an image display device and a driving method thereof, and in particular to an image display device having a pre-charging function to stabilize a state of data signal lines which are successively scanned by a data signal line driving circuit and to improve a writing performance of a video signal, and a driving method thereof. Further, the present invention relates to an image display device having a non-match image display mode which enables display of a video image, an aspect ratio of which differs from that of a screen of a display device, and a driving method thereof.

BACKGROUND OF THE INVENTION

The following will explain one example of a conventional image display device, i.e. an active matrix type liquid crystal display device. As shown in FIG. 9, this image display device is made up of a pixel array ARY, a scanning signal line driving circuit GD, a data signal line driving circuit SD and a pre-charging circuit PC.

The pixel array ARY includes a plurality of scanning signal lines GL and a plurality of data signal lines SL crossing one another, and pixel PIX which is arranged in a matrix is formed within each area enclosed by two adjacent scanning signal lines GL and two adjacent data signal lines SL. A display section displays an image by writing a video signal DAT from each data signal line SL into each pixel PIX in synchronism with a scanning signal outputted from each scanning signal line GL.

As shown in FIG. 10, the pixel PIX is made up of a switching element SW, a liquid crystal capacitor CL and an auxiliary capacitor Cs. A pixel capacitor Cp is a sum of the liquid crystal capacitor CL and auxiliary capacitor Cs. The data signal line driving circuit SD makes sampling of the video signal DAT which was inputted by an analog switch, in synchronism with a timing signal such as a clock signal CKS and a data start signal SPS, and writes the received video signal DAT into each data signal line SL as required.

The scanning signal line driving circuit GD successively selects the scanning signal line GL in synchronism with the timing signal such as the clock signal CKG, a scanning start signal SPG and a pulse width control signal PWC, and carries out opening and closing of the switching element SW within the pixel PIX, thereby writing the video signal DAT which was inputted to each data signal line SL into each pixel PIX, and holding the video signal DAT which was written into the capacitors within each pixel PIX.

The pre-charging circuit PC makes sampling of a pre-charging voltage PCV which was inputted in synchronism with a timing of a pre-charging control signal PCC, and writes the pre-charging voltage PCV before the video signal DAT is written into each data signal line SL.

By repeating the foregoing operations, an image can be displayed in the pixel array ARY.

FIG. 11 shows a timing chart of the foregoing operations. In FIG. 11, the video signal DAT is inputted in synchronism with the clock signal CKS and data start signal SPS of the data signal line driving circuit SD. A driving method of a horizontal line reversal system is adopted in this example, and a video signal having a positive polarity is written into a line which corresponds to a scanning signal line GLj ($j \geqq 1$), while a video signal having a negative polarity is written into a line which corresponds to a scanning signal GLj+1. Further, in a horizontal retrace line period, the data signal line SL is charged to the pre-charging voltage PCV by the pre-charging control signal PCC. Here, polarities of the pre-charging voltage PCV and the video signal DAT to be written next are the same.

In recent years, as image display devices have been refined, a higher sampling rate has been adopted in the data signal line driving circuit SD. This, however, involves a problem of considerable deterioration of image quality caused by the video signal DAT which was incompletely written into the data signal line SL due to the higher sampling rate. Therefore, there has been adopted a method, which suppresses such deterioration of image quality by using the pre-charging circuit PC to pre-charge the pre-charging voltage PCV before writing the video signal DAT into the data signal line SL.

Referring to FIG. 9 which shows a conventional example of the image display device, the following will explain an operation thereof. The pre-charging circuit PC charges each data signal line SL with the pre-charging voltage PCV in synchronism with the timing of the pre-charging control signal PCC.

However, as shown in a timing chart of FIG. 11, in order to supply all of the data signal lines SL with the pre-charging voltage PCV in a short period of time, a group of switching elements which composes the pre-charging circuit PC is required to be large. Furthermore, since the group of the switching elements is collectively controlled, a large quantity of charges are transferred to each data signal line SL at once, thereby fluctuating the pre-charging voltage PCV.

When the fluctuating pre-charging voltage PCV does not return to its original state before the sampling thereof ends, a level of the pre-charging voltage PCV to be supplied to the data signal line SL becomes deficient. As a result, this may adversely affect a voltage of the video signal DAT to be written into the data signal line SL by the data signal line driving circuit SD, thus, deterioration of display may be resulted therefrom. Furthermore, an abrupt change in the pre-charging voltage PCV may trigger power fluctuation, which causes all of the control signals to become unstable, thereby possibly resulting in poor display.

As discussed, an attempt has been made to suppress fluctuation in the pre-charging voltage PCV, in which, as shown in FIG. 9, a current amplifying section is provided on a following stage of a control signal generating circuit CTL. However, this raises a new problem of increasing power consumption due to the current amplifying section thus provided.

Meanwhile, in recent years, an active-matrix liquid crystal display device has frequently been adopted to TV (television) monitors, portable information terminals and others. Therefore, video sources for display have been diversified, and it is often the case where an aspect ratio of a video or image to be displayed does not match an aspect ratio of a screen of a display device. For example, in one case, a liquid crystal display device which principally displays TV pictures according to an NTSC system is used to display a Hi-Vision broadcast of an MUSE system, etc., by converting it into the NTSC system. In the other case, a liquid crystal display device having an aspect ratio of 16:9 which principally displays TV images according to a Hi-Vision television standard is used to display TV pictures of the NTSC system having an aspect ratio of 4:3.

Generally, when displaying a picture or an image having an aspect ratio which does not match an aspect ratio of the screen of a display device (hereinafter referred to as "non-match image display mode"), and when, for example, displaying a video source having an aspect ratio of 16:9 by a liquid crystal display device having a screen aspect ratio of 4:3, a picture to be displayed by the liquid crystal display device may become such that, as shown in FIG. 24, black display occurs in upper and lower parts of the screen, or as shown in FIG. 25, the picture is cut on both sides. However, in the latter case where the height of the video source is adjusted to that of the screen when displaying, it is feasible that the reduced portion of the picture may contain important information. Therefore, commonly, the former in which the width of the video source is adjusted to that of the screen when displaying is more widely adopted. Note that, hereinafter, a "wide mode" refers to display of a video source having an aspect ratio of 16:9, and a "normal mode" refers to display of a video source having an aspect ratio of 4:3.

Further, a video camcorder, for example, often adopts a liquid crystal display device, where the most popular aspect ratio for a display screen is 4:3. However, nowadays, the screen of a TV which is larger in the width than the height ("wide TV", hereinafter) has been the mainstream of home TVs, and when displaying a picture recorded by the video camcorder on this wide TV, upper and lower parts of the picture are lost. Therefore, in order to prevent such a partial loss of the picture have been taken measures; for example, a widely adopted method is such that, when videotaping by the video camcorder, as shown in FIG. 24, black display in the upper and lower parts is strategically carried out in advance during display of a picture by a liquid crystal display device of the video camcorder, thereby preventing the loss of the picture in the upper and lower parts on a screen of the wide TV.

On the other hand, as a system to display a picture having an aspect ratio of 4:3 by a display device which principally displays TV pictures according to the Hi-Vision television standard, proposed is a method such that a whole image is displayed in the center of a screen in the normal mode, where margins on both sides of the screen are given a mask of a black or arbitrarily selected color. For example, the Letters Patent of U.S. Pat. No. 5,625,376 (Date of Patent: Apr. 29, 1997) discloses an active matrix display device which has a pixel group, pixels of which are disposed along rows and columns on a wide screen, a gate line group, each gate line of which is connected to each row of pixels, a vertical driving circuit connected to the gate line group, a data line group each data line of which is connected to each column of pixels, signal lines, each of which supplies a picture signal from the outside, a sampling switch group which connects the signal lines and the data line group, and a horizontal shift register which controls successive opening and closing of the sampling switch group, wherein the columns of pixels on a wide screen are separated into a predetermined region for the normal display and an extended region for the wide mode display, the horizontal shift register is separated into extension stage portions, one of which corresponds to the columns of pixels in the predetermined region and the other the columns of pixels in the extended region, and in the normal mode, in the horizontal shift register, the predetermined stage portions and the extended stage portions are serially connected and integrated, while in the normal mode, the extended stage portions of the horizontal shift register are disconnected so as to successively carry out opening and closing of only a sampling switch pertaining to the predetermined region among the whole sampling switch group. Note that, in this display device, in the normal mode, data lines pertaining to the extended region on both ends of the screen are provided with signals of a fixed level by mask means so as to perform mask display in the extended region, while using the whole screen in the wide mode.

Among these liquid crystal display devices above, a conventional image display device which performs black display in the upper and lower parts of a screen includes an active matrix liquid crystal display device, that will be explained below. This image display device, as shown in FIG. 21, includes a pixel array ARY, a scanning signal line driving circuit GD, a data signal line driving circuit SD, a pre-charging circuit PC and a control signal generating circuit CTL. Further, as pre-charging voltage stabilizing means for stabilizing a pre-charging voltage PCV to be inputted to the pre-charging circuit, a current amplifying section Buffer is provided on a preceding stage of the pre-charging circuit PC.

The pixel array ARY has a plurality of scanning signal lines GLj (j=1 to n) and a plurality of data signal lines SDLi (i=1 to m) crossing each other, and the pixels PIX in matrix are each disposed in a portion enclosed by the two adjacent scanning signal lines GLj and the two adjacent data signal lines SDLi. A display section made up of the pixel array ARY has an arrangement in which a video signal DAT from each data signal line SDLi is written into each pixel PIX in synchronism with a scanning signal from each scanning signal line GLj.

The pixel PIX, as shown in FIG. 10, includes a switching element SW, a liquid crystal capacitor CL and an auxiliary capacitor Cs. A pixel capacitor Cp is the sum of the liquid crystal capacitor CL and the auxiliary capacitor Cs.

The data signal line driving circuit SD makes sampling of the video signal DAT inputted by an analog switch, in synchronism with a timing signal such as a clock signal CKS and a data start signal SPS, and writes the received video signal DAT into each data signal line SDLi as required.

The scanning signal line driving circuit GD successively selects the scanning signal line GLj in synchronism with the timing signal such as a clock signal CKG, a scanning start signal SPG and a pulse width control signal PWC, and carries out opening and closing of the switching element SW within the pixel PIX, thereby writing the video signal DAT which was inputted to each data signal line SDLi into each pixel PIX, and holding the video signal DAT which was written into the capacitors within each pixel PIX.

The pre-charging circuit PC makes sampling of a pre-charging voltage PCV which was inputted in synchronism with a timing of a pre-charging control signal PCC, and writes the pre-charging voltage PCV before the video signal DAT is written into each data signal line SDLi. By repeating the foregoing operations, an image can be displayed in the pixel array ARY.

Further, when displaying an image in the wide mode, as shown in FIG. 24, black display is carried out in the upper and lower parts of the 4:3 screen. Here, a signal voltage which is the equivalent of the video signal DAT for the black display is added to the pre-charging voltage PCV within a vertical retrace line period of the video signal DAT, and the voltage is supplied from the pre-charging circuit PC to each data signal line. On the other hand, the clock signal CKG of the scanning signal line driving circuit is driven at a frequency which is four times a frequency of the clock signal CKG in a display area. This, accordingly, causes the pulse width control signal PWC to be also inputted at a frequency which is four times a frequency thereof, thereby driving the scanning signal line. The signal voltage that is the equivalent of the video signal DAT for the black display supplied from the pre-charging circuit PC to each data signal line is written into the pixel, thereby forming a black display area.

FIGS. 22 and 23 show timing charts of the foregoing operations. In FIGS. 22 and 23, the video signal DAT is inputted in synchronism with the clock signal CKS (not shown) and the data start signal SPS in the data signal line driving circuit SD. A driving method of a horizontal line reversal system is adopted in this example, where, in the wide mode, in order to thin out data in an effective pixel area 1H, gate scanning is partially suspended, and the reversal occurs for every line on the screen. A video signal having a positive polarity is written into a line which corresponds to a scanning signal line $GL2_{j-1}$ (j=15 to (n/2−14), provided n is an even number), while a video signal having a negative polarity is written into a line which corresponds to a scanning signal $GL2_j$. Further, in a horizontal retrace line period, the data signal line SDLi (i=1 to m) is charged to the pre-charging voltage PCV by the pre-charging control signal PCC. Note that, polarities of the pre-charging voltage PCV and the video signal DAT to be written next are the same.

However, in the foregoing image display device, though provision of the current amplifying section Buffer enables stable supply of the pre-charging voltage PCV, yet there arises a problem that the current amplifying section Buffer increases power consumption.

SUMMARY OF THE INVENTION

In view of the foregoing problems, it is an object of the present invention to provide an image display device having a pre-charging function to (i) suppress an increase of power consumption, and to (ii) particularly improve a writing performance of writing a video signal into a data signal line, and a driving method of such an image display device.

In order to attain the foregoing object, the image display device according to the present invention includes:

a plurality of pixels disposed in a matrix;

a display section, having a plurality of data signal lines for respective columns of the plurality of pixels and having a plurality of scanning signal lines corresponding to respective rows of the plurality of pixels, for displaying an image by writing a video signal from each data signal line into each pixel in synchronism with a scanning signal which is outputted from each scanning signal line;

a data signal line driving circuit for outputting the video signal to the plurality of data signal lines;

a scanning signal line driving circuit for outputting the scanning signal to the plurality of scanning signal lines; and a pre-charging circuit for charging the plurality of data signal lines to a pre-charging voltage in a predetermined period of time in accordance with a pre-charging control signal, wherein a pre-charging voltage stabilizing section for suppressing fluctuation in the pre-charging voltage is provided on a preceding stage of the pre-charging circuit.

With this image display device, by including the pre-charging voltage stabilizing section, fluctuation in a pre-charging voltage can be suppressed, and thus the data signal lines can be charged to a desired potential, and deterioration of image quality of the image display device can be suppressed. In addition, since the image display device does not require a current amplifying circuit, an increase of power consumption can be suppressed.

The pre-charging voltage stabilizing section is preferably made up of current controlling means and charge holding means. In this case, since the voltage (charge) supplied to the data signal line is held by the charge holding means, the charge can be supplied from the charge holding means while the pre-charging control signal is working. Further, the pre-charging voltage supplied from the control signal generating circuit may only be applied to the charge holding means while the pre-charging control signal is not working, and only a necessary amount of current is flown into the charge holding means by using the current controlling means. Thus, power consumption can be reduced.

A driving method of the image display device according to the present invention includes:

a plurality of pixels disposed in a matrix;

a display section having a plurality of data signal lines for respective columns of the plurality of pixels and having a plurality of scanning signal lines corresponding to respective rows of the plurality of pixels, the display section for displaying an image by writing a video signal from each data signal line into each pixel in synchronism with a scanning signal which is outputted from each scanning signal line;

a data signal line driving circuit for outputting the video signal to the plurality of data signal lines;

a scanning signal line driving circuit for outputting the scanning signal to the plurality of scanning signal lines; and a pre-charging circuit for charging the plurality of data signal lines to a pre-charging voltage in a predetermined period of time in accordance with a pre-charging control signal, comprises the step of supplying the pre-charging voltage to a pre-charging voltage stabilizing section which is made up of current controlling means and charge holding means and is provided on a preceding stage of the pre-charging circuit, the pre-charging voltage having an AC voltage in synchronism with one horizontal period of the video signal.

With the foregoing driving method, when the video signal is in the state of positive or negative polarity, by making the pre-charging voltage to have the AC voltage in synchronism with the polarity change, it is possible to (a) charge the data signal line with an optimum pre-charging voltage, (b) suppress fluctuation in the pre-charging voltage, and (c) charge the data signal lines with a desired voltage, thereby suppressing deterioration of image quality of the image display device.

The foregoing pre-charging voltage stabilizing section is made up of a pre-charging voltage stabilizing circuit which includes passive elements (for example, a resistor R for limiting a current and a capacitor C for holding a charge), thereby providing an image display device capable of preventing fluctuation in the pre-charging voltage PCV and reducing power consumption.

In the foregoing image display device, it is advantageous that an arrangement which has the pre-charging voltage stabilizing section made up of passive elements results in preventing fluctuation in the pre-charging voltage PCV and reducing power consumption of the pre-charging voltage stabilizing circuit. However, when adopting a conventional driving method in which an image display device having an aspect ratio of 4:3 is used to display a picture having an aspect ratio of 16:9, a scanning signal is generated before the capacitor C for holding a charge is sufficiently charged to the pre-charging voltage PCV, then, a voltage which is less than an essentially required signal voltage which is the equivalent of the video signal DAT for black display is written into a pixel, thereby causing impairment of an image quality. This is also the case when an image display device having an aspect ratio of 16:9 is used to display a picture having an aspect ratio of 4:3.

Consequently, the object of the present invention is to provide an image display device having a display device and a driving circuit thereof which are integrally formed on a single substrate, and pre-charging voltage stabilizing means on a preceding stage of a pre-charging circuit, so as to attain a non-match image display mode without reduction in an image quality even when adopting a pre-charging voltage stabilizing circuit including passive elements as the pre-charging voltage stabilizing means, and to reduce power consumption.

Further, in order to attain the foregoing object, the present invention has an arrangement in which as a pre-charging voltage stabilizing section (means) for controlling fluctuation in a pre-charging voltage PCV is adopted the pre-charging voltage stabilizing circuit including passive elements, where, when performing display at fixed brightness during a non-match image display mode by a pre-charging voltage which was inputted from the pre-charging circuit to a video data non-display area provided on one portion of a screen of a display section, a scanning signal is suspended for a predetermined period of time.

More specifically, in a driving method of an image display device according to the present invention, the image display device includes:

a plurality of pixels disposed in a matrix;

a display section, having a plurality of data signal lines for respective columns of the plurality of pixels and having a plurality of scanning signal lines corresponding to respective rows of the plurality of pixels, for displaying an image by supplying a video signal from each data signal line to each pixel in correspondence with a scanning signal which is supplied from each scanning signal line;

a data signal line driving circuit for outputting a video signal to the plurality of data signal lines in synchronism with a predetermined timing signal;

a scanning signal line driving circuit for outputting a scanning signal to the plurality of scanning signal lines by a pulse width control signal which controls an output signal in synchronism with a scanning start signal and a scanning timing signal, and a signal width of the output signal;

a pre-charging circuit for charging the plurality of data signal lines to a pre-charging voltage by a pre-charging control signal in a predetermined period of time;

pre-charging voltage stabilizing means for stabilizing a pre-charging voltage, which is followed by the pre-charging circuit; and a control signal generating circuit for supplying the circuits with a control signal so as to control operations thereof, the driving method including the step of suspending a scanning signal for a predetermined period of time when a pre-charging voltage stabilizing circuit having charge holding means and current controlling means as the pre-charging voltage stabilizing means is used to perform display at fixed brightness in first and second display areas which are respectively provided corresponding to a first portion and/or a second portion on a screen of the display section by a pre-charging voltage inputted from the pre-charging circuit.

In the non-match image display mode, of the whole screen of the display section, a region being a video data non-display area can arbitrarily be provided either in an upper part and/or a lower part of the screen or on the left and/or the right side of the screen. Normally, in the case of the display device having a screen of an aspect ratio 4:3, it is preferable that the video data non-display area in the non-match image display mode be provided in the upper part and/or the lower part of the screen of the display section. In that case, the scanning signal line driving circuit is provided on the left and/or the right side of the screen. Further, in the case of the display device having a screen of an aspect ratio 16:9, it is preferable that the video data non-display area in the non-match image display mode be provided on the left and/or the right side of the screen of the display section. In that case, the scanning signal line driving circuit is provided in the upper part and/or the lower part of the screen.

In the non-match image display mode, the fixed brightness for display in a video data non-display area to be provided in one portion of the screen of the display section, for example, in an upper display area or a lower display area is not necessarily be the brightness corresponding to a black color, and brightness can arbitrarily be set at the brightness corresponding to a dark blue color, a white color, or the other arbitrarily selected color.

Further, as a driving method of the scanning signal line driving circuit, as with an example to be discussed later, a line sequential driving method may be adopted, and alternatively, a point sequential driving method may also be adopted.

In a preferable example, when allowing a black display area in an upper part of a screen to perform black display in the upper and lower parts of the screen by a pre-charging voltage having the equivalent of a black display voltage of a video signal inputted from the pre-charging circuit, input of a scanning start signal to the scanning signal line driving circuit is suspended for a predetermined period of time. In addition, in another example, when allowing the black display area in the upper part of the screen to perform black display by a pre-charging voltage having the equivalent of the black display voltage of the video signal inputted from the pre-charging circuit, input of both a scanning start signal and a scanning timing signal to the scanning signal line driving circuit is suspended for a predetermined period of time.

Various methods may be adopted as suspending means for the scanning signal. For example, input of the scanning start signal may be suspended for a predetermined period of time, or alternatively, input of both the scanning signal start signal and the scanning timing signal may be suspended for a predetermined period of time. Alternatively, suspending means for the scanning signal may suspend the input of the scanning timing signal and the pulse width control signal for the predetermined period of time.

In another example, when allowing a black display area in a lower part of the screen to perform black display by a pre-charging voltage having the equivalent of the black display voltage of the video signal inputted from the pre-charging circuit, input of the scanning timing signal and the pulse width control signal to the scanning signal line driving circuit are suspended for a predetermined period of time.

A predetermined period of time for suspending the scanning signal may be set at a time constant or more of current controlling means and charge holding means making up the pre-charging voltage stabilizing circuit. In addition, the predetermined period of time may be not less than the time required for the sufficient stabilization of the pre-charging voltage.

The switching element which makes up each circuit and each pixel may be either a monocrystalline silicon transistor or a polycrystalline silicon thin film transistor, and the latter is more preferably used to form the pre-charging circuit, the data signal line driving circuit, the scanning signal line driving circuit and the pixels on a single substrate. The following will explain the reason. When using the monocrystalline silicon to produce an element, a transistor having a superior characteristic can be obtained. However, this poses problems such that it is difficult to expand a display area and that it is necessary to form the driving circuit and pixels on different substrates and connect the substrates by the signal lines as occasion demands, thereby increasing the number of processes in manufacture and capacitance of each signal line. On the other hand, compared to the monocrystalline silicon transistor, the polycrystalline silicon thin film transistor produced using a polycrystalline silicon thin film, for example, has inferior transistor characteristics including mobility and a threshold value. It is a problem that the use of this polycrystalline silicon thin film transistor to form circuits results in reduced driving abilities of the circuits. Nevertheless, the polycrystalline silicon thin film transistor has such an advantage that it allows an area to expand more easily than the monocrystalline silicon. Therefore, by adopting the polycrystalline silicon thin film transistor to form a switching element, the display area can readily be expanded, thereby making it possible to form the circuits on a single substrate and reducing the number of manufacturing steps and capacitance of each signal line.

In that case, switching elements making up the pre-charging circuit, the data signal line driving circuit, the scanning signal line driving circuit and the pixels, respectively, may be produced at a process temperature of not more than 600° C. By thus producing each switching element at the process temperature of not more than 600° C., even when using an inexpensive, ordinary glass substrate (glass substrate whose point of deformation comes at not more than 600° C.) as the substrate for forming the switching element, warp and flexure which may be caused by a process exceeding the point of deformation do not occur. As a result, an easy-to-mount and inexpensive glass substrate can be used for manufacture of an image display device, thereby realizing an image display device having a larger display area.

Consequently, the present invention is also to provide an image display device which adopts the polycrystalline silicon thin film transistor so as to form the pre-charging circuit, the data signal line driving circuit, the scanning signal line driving circuit and the pixels on a single substrate, wherein a pre-charging voltage stabilizing circuit having charge holding means and current controlling means is provided on a preceding stage of the pre-charging circuit, and a control signal generating circuit includes a control signal generating section for suspending a scanning signal for a predetermined period of time when performing display in the non-match image display mode at fixed brightness in a video data non-display area which is provided in one portion of the screen of the display section and does not display video data, by a pre-charging voltage inputted from the pre-charging circuit.

In the present invention, the pre-charging voltage stabilizing circuit having charge holding means and current controlling means is adopted as the pre-charging voltage stabilizing means, and when performing black display in an upper black display area and a lower black display area which are respectively provided in the upper and lower parts of the screen of the display section, by a pre-charging voltage from the pre-charging circuit, a scanning signal is suspended for a predetermined period of time, thereby supplying a scanning signal after sufficiently storing charges in the charge holding means of the pre-charging voltage stabilizing circuit, charging a pixel to the equivalent of a black display voltage, suppressing fluctuation in the pre-charging voltage in an area to display a video signal, and charging each data signal line to a desired voltage, thus suppressing impairment of an image quality of the image display device.

Additional objects, features, and strengths of the present invention will be made clear by the description below. Further, the advantages of the present invention will be evident from the following explanation in reference to the drawings.

DESCRIPTION OF THE EMBODIMENTS

Figure 1:
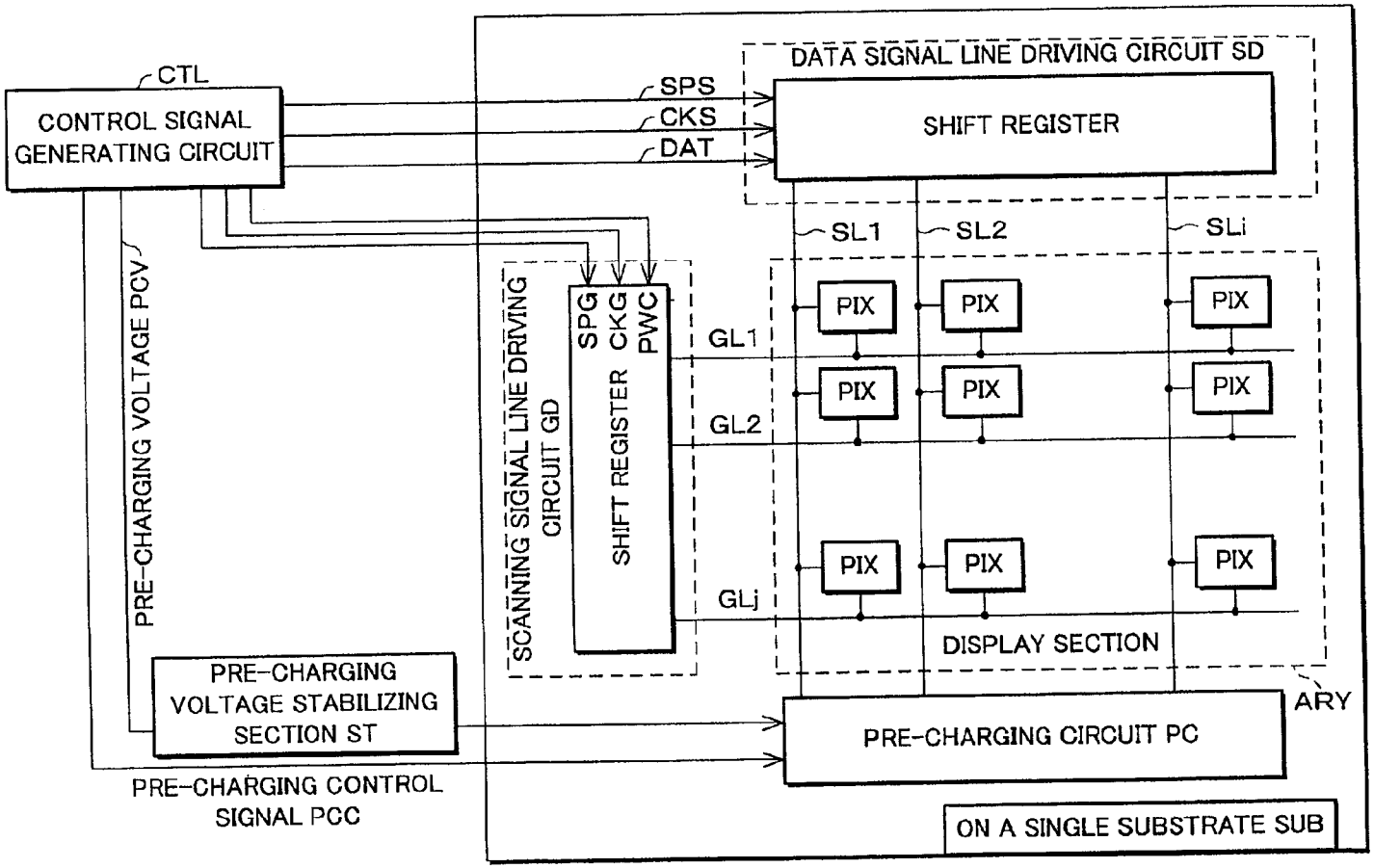
FIG. 1 is a block diagram showing an example of a structure of an image display device of the present invention.

The following will explain a First Embodiment according to the present invention with reference to drawings. FIG. 1 is a block diagram showing one example of a structure of an image display device.

Figure 2:
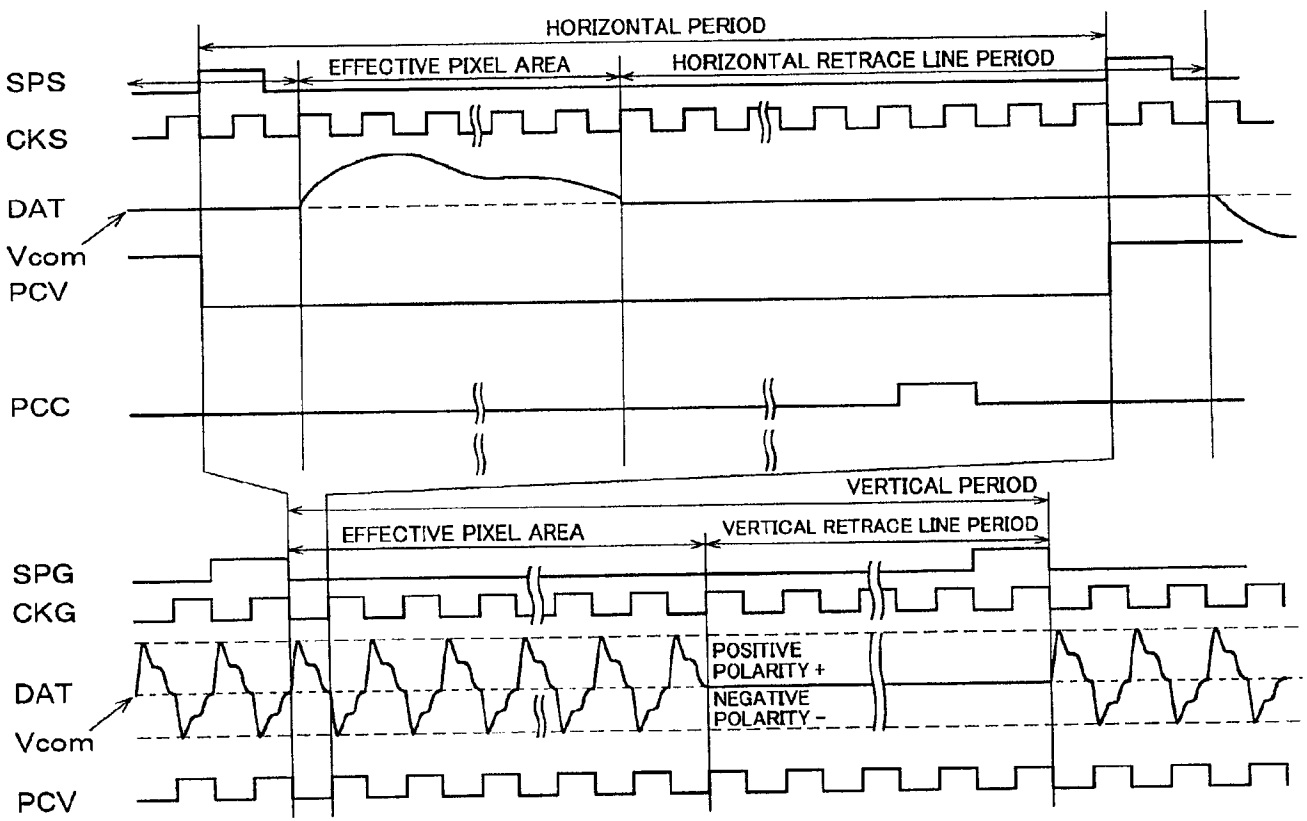
FIG. 2 is a timing chart according to the image display device of FIG. 1.

As shown in FIG. 1, the image display device according to the present invention is made up of: a data signal line driving circuit SD; a scanning signal line driving circuit GD; a data signal line SLi ($i \geqq 1$); a scanning signal line GLj ($j \geqq 1$); a pixel PIX; a control signal generating circuit CTL; a pre-charging circuit PC; and a pre-charging voltage stabilizing section ST. The control signal generating circuit CTL outputs each control signal in a manner shown in a timing chart of FIG. 2.

In addition, respective switching elements of the data signal line driving circuit SD, scanning signal line driving circuit GD, pre-charging circuit PC and each pixel PIX are made from a polycrystalline silicon thin film transistor at a process temperature of not more than 600° C. on a single substrate SUB.

Figure 3:
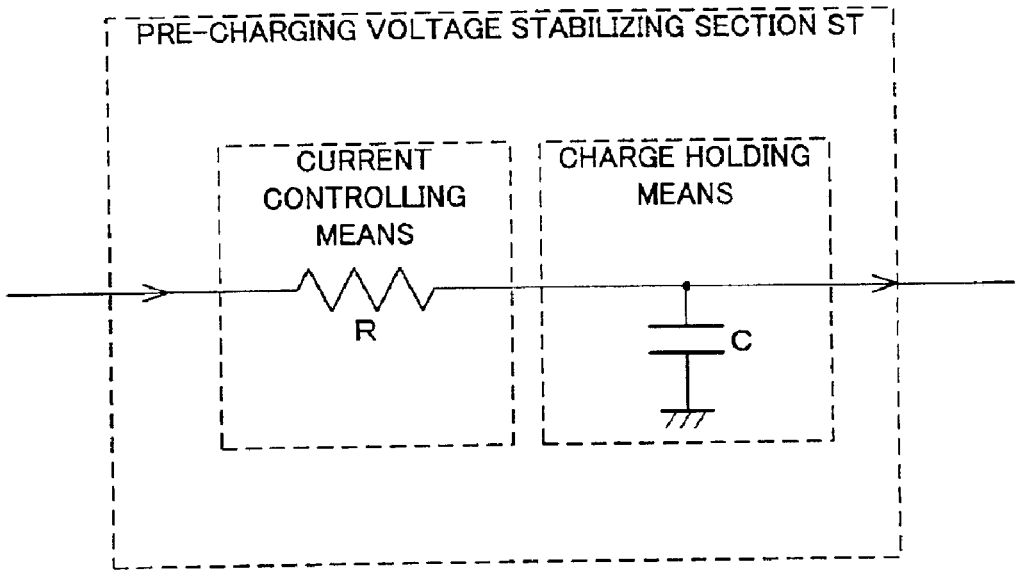
FIG. 3 is a circuit diagram showing a structure of a pre-charging voltage stabilizing section of the present invention.

Further, as shown in FIG. 3, the pre-charging voltage stabilizing section ST is made up of charge holding means and current controlling means. Here, the charge holding means is a capacitor C, while the current controlling means is a resistor R in order to suppress power consumption.

A capacitance of the capacitor C of the charge holding means needs to be at least larger than the total capacitance of a plurality of data signal lines SL. That is, the capacitor C is only required to supply a charge stored by the charge holding means while the pre-charging control signal PCC is active, and is not required to newly supply a charge from the control signal generating circuit CTL, thereby suppressing the amount of currents and accordingly, power consumption.

By the resistor R which is the current controlling means, a current flown from the control signal generating circuit CTL is suppressed, thus suppressing power fluctuation, which may occur in the control signal generating circuit CTL.

Figure 4:
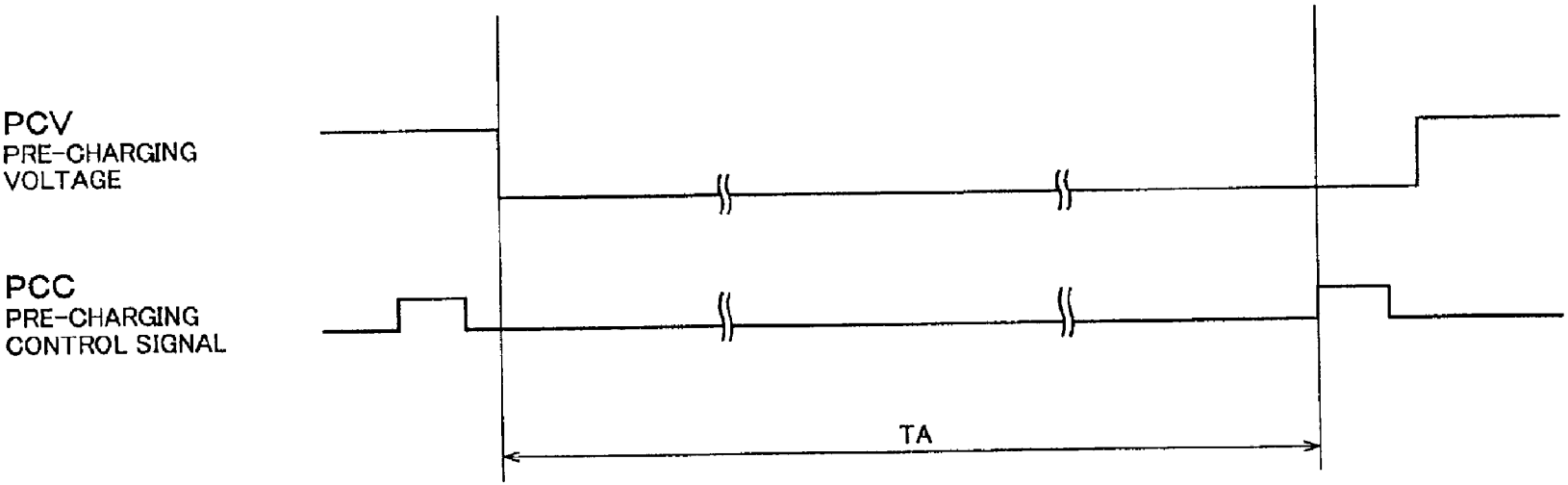
FIG. 4 is a timing chart showing a relation between a pre-charging voltage and a pre-charging control signal.
Figure 5:
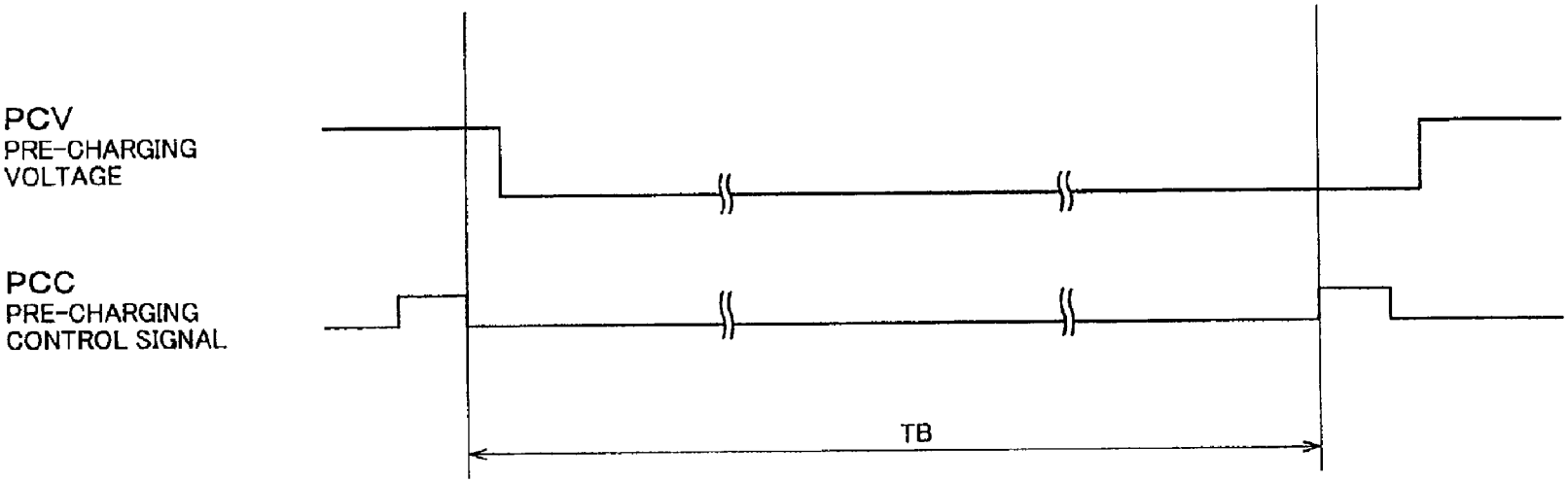
FIG. 5 is a timing chart showing a relation between the pre-charging voltage and pre-charging control signal.

When a pre-charging voltage PCV is an AC voltage, time constants of the current controlling means and charge holding means making up the pre-charging voltage stabilizing section ST need only be shorter than the time (duration TA of FIG. 4) between switching of the polarity of the pre-charging voltage PCV and next activation of the pre-charge control signal PCC. Alternatively, the time constants of the current controlling means and charge holding means making up the pre-charging voltage stabilizing section ST need only be shorter than the time (duration TB of FIG. 5) between activation of the pre-charging control signal PCC and the next activation thereof. In addition, when the pre-charging voltage PCV is the AC voltage, the current controlling means and charge holding means, which make up the pre-charging voltage stabilizing section ST, are to have such an optimum value as to stabilize the pre-charging voltage PCV to a sufficient potential within a period of the pre-charging control signal PCC. For example, in the case of an NTSC signal, a horizontal period (1H) is about 63 $\mu$sec, and a potential can be held sufficiently within this period. Namely, a charge can sufficiently be stored by the charge holding means before the pre-charging control signal PCC comes into operation, and no charge needs to be newly supplied from the control signal generating circuit CTL, thus suppressing the amount of currents, and accordingly, power consumption.

Values of the capacitor C and resistor R are determined from the foregoing relations. In the present case, the capacitor C of 10 nF, and the resistor R of 220 Ω were adopted in the pre-charging voltage stabilizing section ST. However, any other electronic elements can be used instead insofar as they satisfy the foregoing relations.

In the First Embodiment, a driving method called 1H reversal driving is adopted, by which the polarity of the video signal DAT to be written into the pixel PIX is switched between positive and negative for every horizontal period.

Next, the following will explain how the respective elements work. The data signal line driving circuit SD first makes sampling of the video signal DAT having a positive polarity and outputs it to each data signal line SLi in accordance with a data start signal SPS and clock signal CKS shown in FIG. 2. On the other hand, the scanning signal line driving circuit GD successively selects a scanning signal line GLj based on the scanning start signal SPG and clock signal CKG, and opens or closes a switching element SW of the pixel PIX connected to the scanning signal line GLj, thereby transferring the video signal DAT, which was sampled to the data signal line SLi, to the pixel PIX. Here, the video signal DAT having a positive polarity is held by the pixel PIX.

Meanwhile, as explained in the Background of the Invention, in the case of a liquid crystal display device, the pixel PIX is composed of the switching element SW, a liquid crystal capacitor CL and a liquid crystal capacitor Cs. These capacitors are connected by one end to the data signal line SL via the switching element SW, and to the other end is applied a voltage named counter voltage. That is, the video signal DAT which was written into the pixel PIX is applied to a liquid crystal by a potential difference between the video signal DAT and an counter voltage Vcom, and various display states are realized by modulating the light which passes through the liquid crystal.

In the First Embodiment, the counter voltage Vcom (marked with a dotted line in FIG. 2) is given with a DC voltage, and the positive and negative polarities of the video signal DAT are indicated on the basis of the counter voltage Vcom.

Next, when the scanning signal line GLj is selected by the scanning signal line driving circuit GD, the pixel PIX is disconnected from the data signal line SL by the switching element SW. Here, the video signal DAT of the positive polarity has been written into the data signal line SL by the data signal line driving circuit SD. Therefore, the pre-charging circuit PC applies the pre-charging voltage PCV of an arbitrary level to the data signal line SL, the pre-charging voltage PCV having the same negative polarity as with the video signal DAT having a negative polarity, which is to be written next by the data signal line driving circuit SD next.

In the First Embodiment, to the pre-charging circuit PC are inputted the pre-charging control signal PCC, and the pre-charging voltage PCV which always has a polarity opposite to the video signal DAT. In addition, the value of the pre-charging voltage PCV and the maximum value of the video signal DAT are set to be the same. Otherwise, the pre-charging voltage PCV may have an AC voltage which is equipotential from the maximum amplification values of the positive and negative polarities of the video signal DAT, respectively. Accordingly, the optimum value of the pre-charging voltage PCV can be selected arbitrarily, and the data signal line SL can be charged to a desired voltage, thus suppressing impairment of image quality in the image display device.

Next, when the pre-charging control signal PCC and the pre-charging voltage PCV are inputted to the pre-charging circuit PC, each data signal line SL is supplied with the pre-charging voltage PCV in accordance with the pre-charging control signal PCC. Here, the capacitor C set in the pre-charging voltage stabilizing section ST has sufficiently been charged to the pre-charging voltage PCV within one horizontal period. Therefore, even if charges start to flow into all of the data signal lines SL in accordance with the pre-charging control signal PCC, fluctuation in the pre-charging voltage PCV can be suppressed to minimum because the charges stored in the capacitor C, which is the charge holding means, also start to flow. Further, the resistor R, which is the current controlling means, suppresses a current flow from the control signal generating circuit CTL, and power fluctuation which may occur in the control signal generating circuit CTL can be suppressed.

When the data signal lines SL are fully charged to the pre-charging voltage PCV, the data signal line driving circuit SD makes sampling of the video signal DAT of a negative polarity to the data signal line SL. Here, since the negative potential has already been held in the respective data signal lines SL, the desired video signal DAT can readily be written into the data signal line SL.

The following will explain a Second Embodiment in accordance with the present invention. Here, the explanation will be given through the case where the pre-charging voltage PCV has a DC voltage in the structure of the First Embodiment.

The current controlling means and charge holding means which make up the pre-charging voltage stabilizing section ST are to have a value which is sufficient to stabilize the pre-charging voltage PCV during a period from feeding power to starting display. By thus increasing the capacitance sufficiently to be larger than the total capacitance of the data signal lines SL, the pre-charging voltage PCV can further be stabilized.

Alternatively, the current controlling means and charge holding means which make up the pre-charging voltage stabilizing section ST may have an optimum value by which more charges can be supplied than the charges supplied to the data signal lines SL by the pre-charging voltage PCV in accordance with the pre-charging circuit PC within a period of the pre-charging control signal PCC. Consequently, if the pre-charging voltage PCV decreases, for example, when the pre-charging control signal PCC rises (when being active), i.e. while supplying the data signal line SL with a charge, it is only required that the pre-charging voltage PCV returns afterwards to the optimum value within a period of the pre-charging control signal PCC. Thus, the data signal line SL can be charged to the pre-charging voltage PCV, thereby suppressing impairment of image quality in the image display device.

Figure 6:
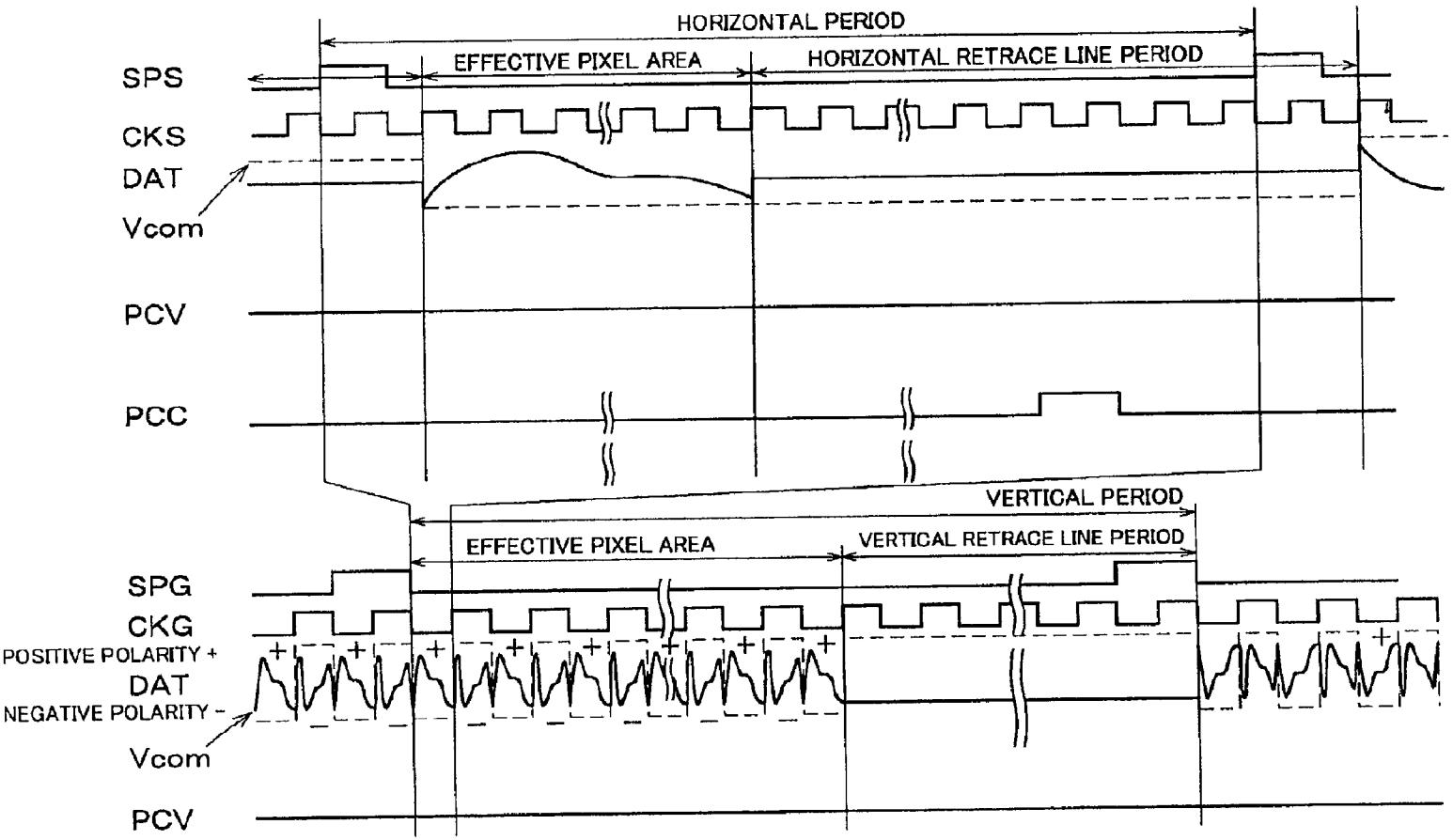
FIG. 6 is a timing chart of another image display device of the present invention.

FIG. 6 shows a timing chart of the respective signals of the Second Embodiment. The timing chart shows a data start signal SPS and a clock signal CKS, and a scanning start signal SPG and a clock signal CKG, which work in the same way as those of the First Embodiment. In addition, a relation between a video signal DAT and a counter voltage Vcom (marked with a dotted line in FIG. 6) is as explained in the First Embodiment, but the counter voltage Vcom is given an AC voltage for every horizontal period (1H) in the Second Embodiment.

Here, the DC voltage is given to the pre-charging voltage PCV, and in the Second Embodiment, the pre-charging voltage PCV is set to be equipotential from the maximum amplification values of positive and negative polarities of the video signal DAT, respectively. That is, in FIG. 2, the polarity of the counter voltage Vcom is changed for every horizontal period (1H), and the counter voltage Vcom becomes a reference to positive or negative polarity. The potential difference between the counter voltage Vcom and the maximum amplification value of the positive polarity, and the potential difference between the counter voltage Vcom and the maximum amplification value of the negative polarity are set to be equal (equipotential).

Further, in the Second Embodiment, the driving method called 1H reversal driving is also adopted, by which the polarity of the video signal DAT to be written into pixel PIX is switched between positive and negative for every horizontal period.

Next, the following will explain how the respective elements work. The data signal line driving circuit SD makes sampling of the video signal DAT having the positive polarity based on the data start signal SPS and the clock signal CKS shown in FIG. 6, and outputs it to each data signal line SL. On the other hand, the scanning signal line driving circuit GD successively selects the scanning signal line GLj based on the scanning start signal SPG and the clock signal CKG, and by opening or closing the switching element SW of the pixel PIX which is connected to the scanning signal line GLj, the video signal DAT which was sampled to the data signal line SL is transferred to the pixel PIX. Here, the video signal DAT of the positive polarity is held by the pixel PIX.

Next, when the scanning signal line GLj is selected by the scanning signal line driving circuit GD, the switching element SW disconnects the pixel PIX from the data signal line SL. Here, the video signal DAT of the positive polarity has been written into the data signal line SL by the data signal line driving circuit SD. Therefore, the pre-charging voltage PCV which is set to be equipotential from the maximum amplification values of the positive and negative polarities of the video signal DAT, respectively, is written into the data signal line SL by the pre-charging circuit PC.

Next, when the pre-charging control signal PCC and the pre-charging voltage PCV are inputted to the pre-charging circuit PC, each data signal line SL is supplied with the pre-charging voltage PCV in accordance with the pre-charging control signal PCC. Here, the capacitor C in the pre-charging voltage stabilizing section ST has sufficiently been charged to the pre-charging voltage PCV within one horizontal period. Therefore, even if charges start to flow into all of the data signal lines SL in accordance with the pre-charging control signal PCC, fluctuation in the pre-charging voltage PCV can be suppressed to minimum because the charges stored in the capacitor C, which is the charge holding means, also start to flow. Further, the resistor R, which is the current controlling means, suppresses a current flow from the control signal generating circuit CTL, and power fluctuation which may occur in the control signal generating circuit CTL can be suppressed.

When the data signal lines SL are fully charged to the pre-charging voltage PCV, the data signal line driving circuit SD makes sampling of the video signal DAT having the negative polarity, and outputs it to the data signal line SL. Here, since the negative potential has already been held in the respective data signal lines SL (due to the fact that the data signal line SL has previously been charged to the pre-charging voltage PCV having the negative polarity), the desired video signal DAT can readily be written into the data signal line SL. Thus, the same effects as obtained in the First Embodiment can also be obtained in the Second Embodiment.

The foregoing has explained the driving method called 1H reversal driving by which the video signal DAT to be written into the pixel PIX is switched between positive and negative for every horizontal period. However, the present invention is applicable to any methods having such a purpose of compensating for the next sampling of the data signal line driving circuit SD by the state of the data signal line SL.

Further, the pre-charging circuit PC and pre-charging voltage stabilizing section ST may have an arrangement in which they are integrated or separated. In addition, the pre-charging circuit PC and pre-charging voltage stabilizing section ST may have an arrangement in which they are formed on a single substrate like the data signal line driving circuit SD and pre-charging circuit PC, i.e. the pre-charging voltage PCV is inputted to the pre-charging circuit PC via the pre-charging voltage stabilizing section ST.

Here, the following will explain a structure of the image display device shown in First and Second Embodiments with reference to drawings. FIG. 1 is a drawing showing a structure of the image display device according to the present invention. As shown in FIG. 1, the image display device is composed of the pixel PIX, the data signal line driving circuit SD, the scanning signal line driving circuit GD, the pre-charging circuit PC, which are formed on the single substrate SUB (driver monolithic structure), and the image display device is driven by a signal sent from the external control signal generating circuit CTL and pre-charging voltage stabilizing section ST.

As shown in FIG. 1, the pre-charging circuit PC, the data signal line driving circuit SD and the scanning signal line driving circuit GD are disposed widely stretching over areas having substantially the same horizontal and vertical lengths as those of a screen (display area).

Further, by forming the pre-charging circuit PC, the data signal line driving circuit SD, and the scanning signal line driving circuit GD with the pixel PIX on the single substrate SUB, manufacturing and mounting costs of the driving circuits can be more reduced and reliability can be increased compared with the case in which they are separately arranged for mounting.

Figure 7:
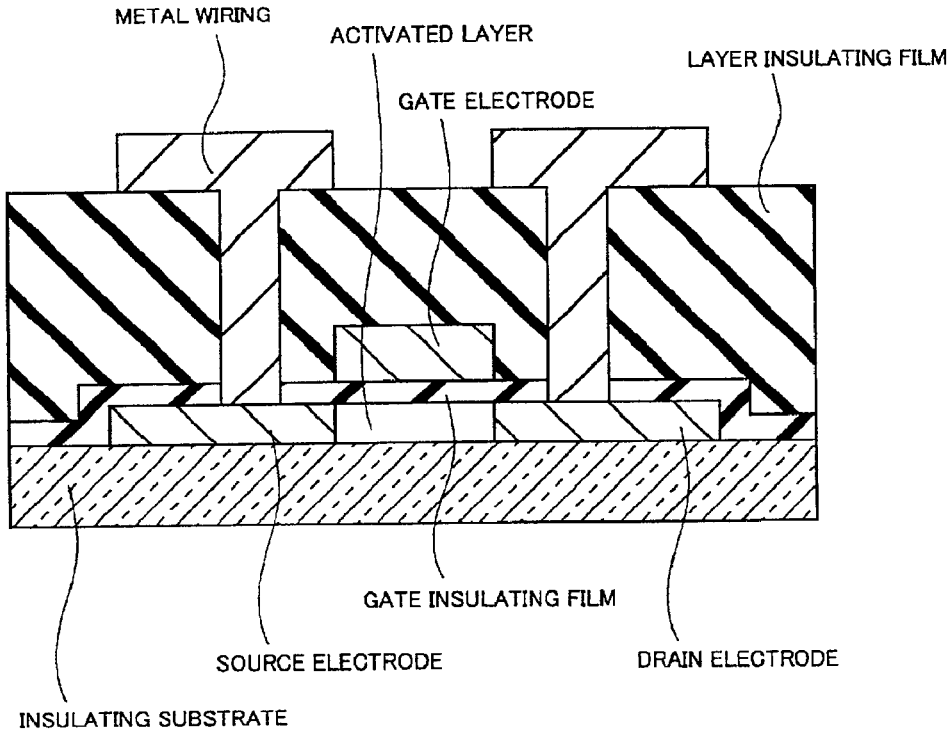
FIG. 7 is an explanatory view showing a structure of a polycrystalline silicon thin film transistor which is a component of the image display device of the present invention.
Figure 8A:
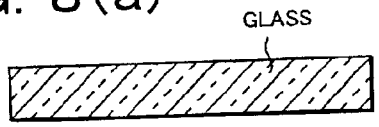
FIGS. 8(*a*) through 8(*k*) are explanatory views showing manufacturing steps of the polycrystalline silicon thin film transistor of FIG. 7.
Figure 8B:
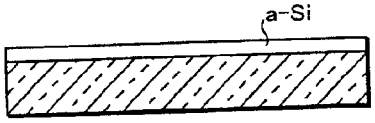
Figure 8C:
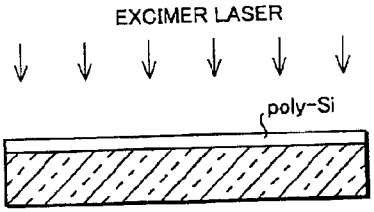
Figure 8D:
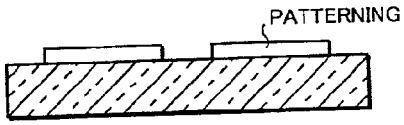
Figure 8E:
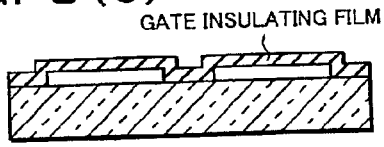
Figure 8F:
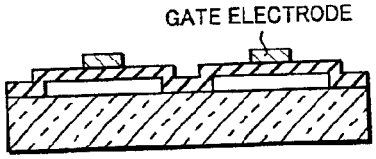
Figure 8G:
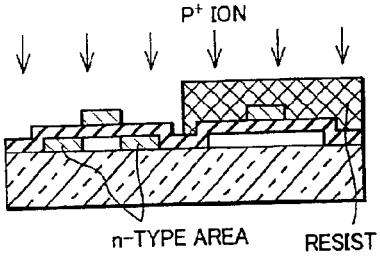
Figure 8H:
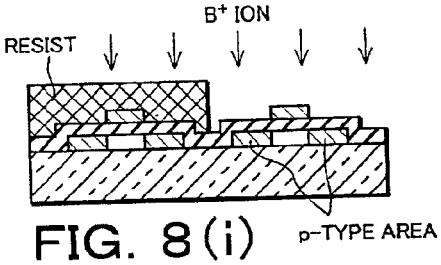
Figure 8I:
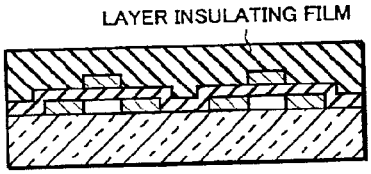
Figure 8J:
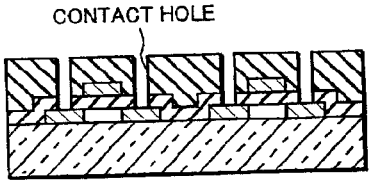
Figure 8K:
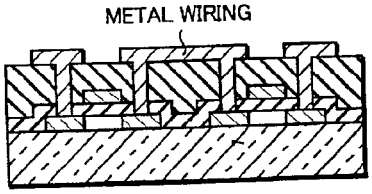
Figure 9:
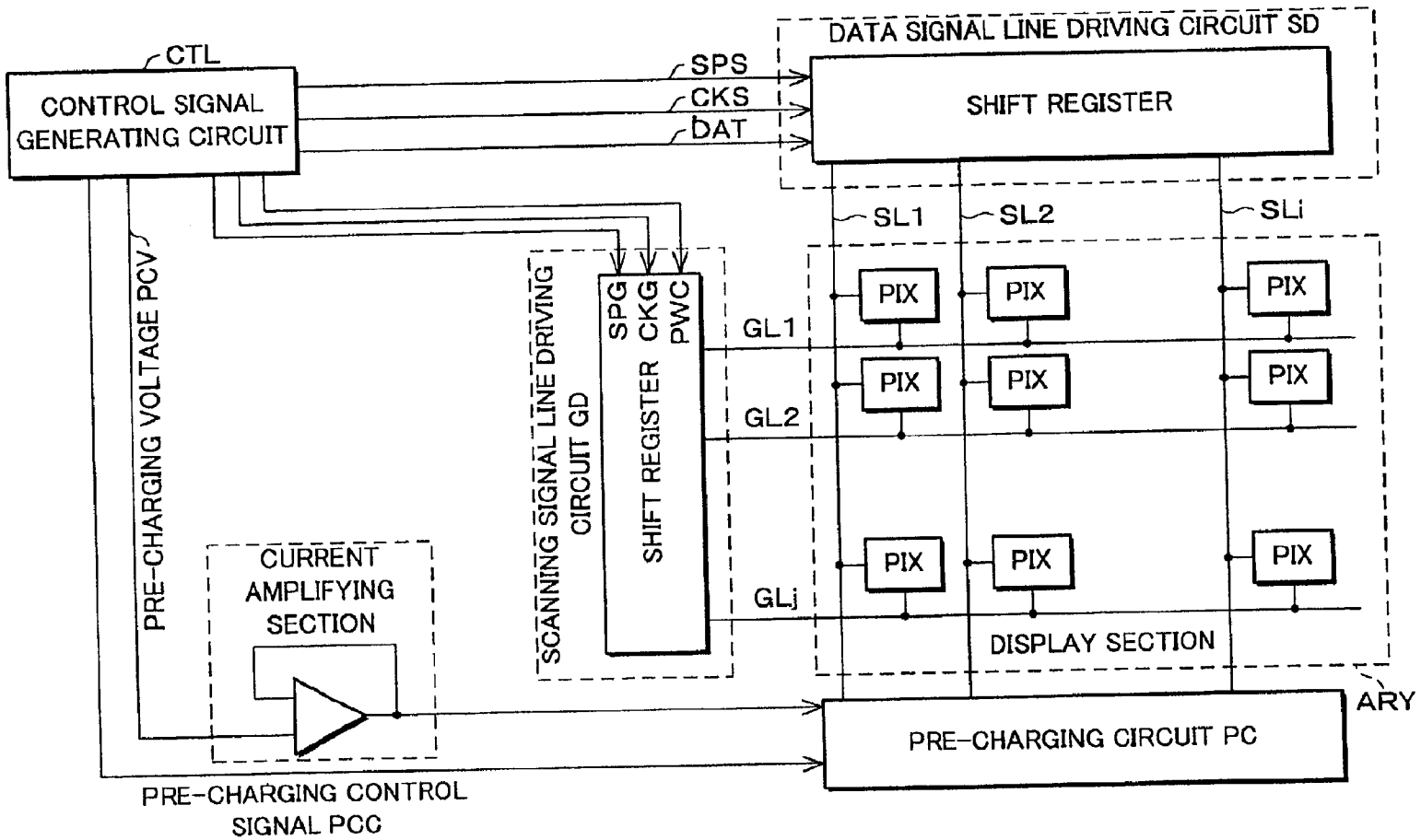
FIG. 9 is a block diagram showing a structure of a conventional image display device.
Figure 10:
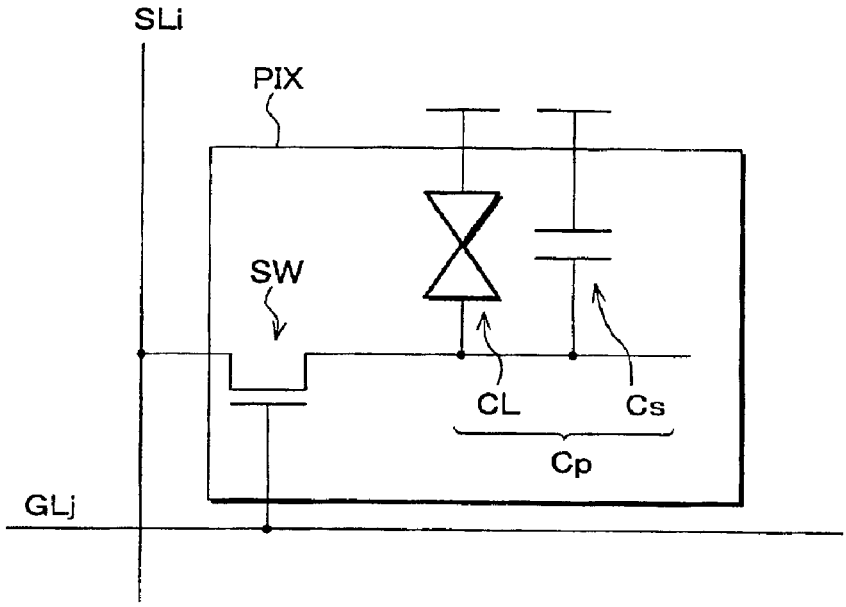
FIG. 10 is an explanatory view showing a structure of a pixel of the conventional image display device.
Figure 11:
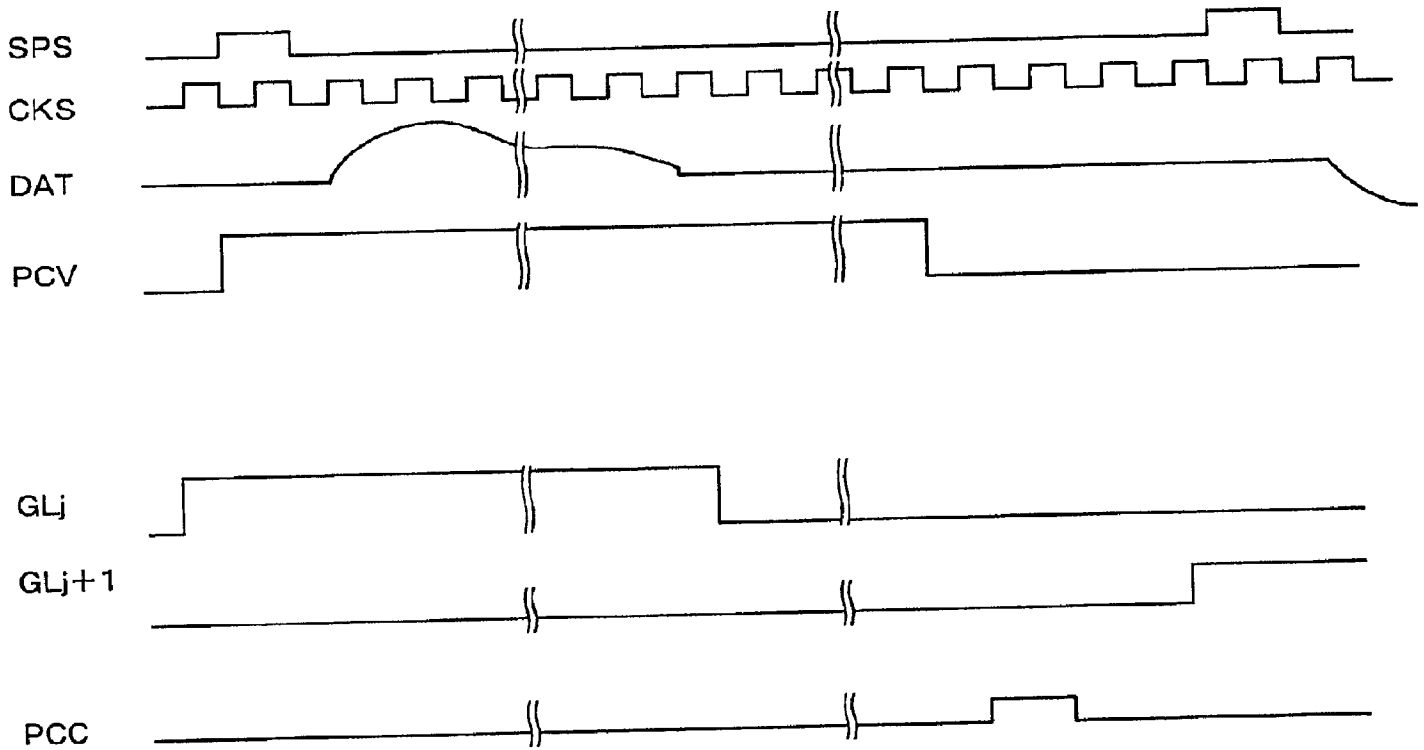
FIG. 11 is a timing chart showing driving waveforms according to the conventional image display device.

FIG. 7 is an example of a structure of a polycrystalline silicon thin film transistor which makes up the image display device of the present invention. As shown in FIG. 7, the polycrystalline silicon thin film transistor has a forward staggered (top gate) structure in which a polycrystalline silicon thin film on an insulating substrate is an activated layer. However, the present invention is not limited to this, but other structures such as a reverse staggered structure may be adopted as well.

By using the polycrystalline silicon thin film transistor, the pre-charging circuit PC, the scanning signal line driving circuit GD, the data signal line driving circuit SD, which have a practical driving performance, can be formed with a pixel array ARY on the single substrate SUB in substantially the same manufacturing process.

FIG. 8 shows a manufacturing process of the polycrystalline silicon thin film transistor which makes up the image display device of the present invention. The following briefly explain the manufacturing process in which the polycrystalline silicon thin film transistor is formed at a maximum temperature of not more than about 600° C. FIGS. 8(*a*) through 8(*k*) are cross sectional views of respective steps.

First, as shown in FIG. 8(*a*), the insulating substrate made of a material such as glass is prepared. Next, as shown in FIG. 8(*b*), an amorphous silicon thin film (a-Si), etc. is deposited on the substrate. Next, as shown in FIG. 8(*c*), a film which was deposited on the substrate is exposed by an Excimer laser so as to form a polycrystalline silicon thin film (poly-Si). Next, as shown in FIG. 8 (*d*), this polycrystalline silicon thin film is patterned in a desired shape. Next, as shown in FIG. 8(*e*), a gate insulating film made of silicon dioxide is formed. Furthermore, as shown in FIG. 8(*f*), a gate electrode of a thin film transistor is formed using aluminum, etc. Afterwards, as shown in FIGS. 8(*g*) and 8(*h*), impurities (phosphorus ion $P^+$ to an n-type area, and boron ion $B^+$ to a p-type area) are injected into source and drain areas of the thin film transistor. A portion where the impurities are not injected is provided with a resist. The source and drain areas becomes a source electrode and a drain electrode, respectively. Afterwards, as shown in FIG. 8(*i*), a layer insulating film made of a material such as silicon dioxide or silicon nitride is deposited. Next, as shown in FIG. 8(*j*), contact holes are formed through the layer insulating film and the gate insulating film. Finally, as shown in FIG. 8 (*k*), metal wiring made of aluminum, etc. is formed. In this process, since the maximum temperature is 600° C. when forming the gate insulating film, highly heat resistant glass such as the 1737 glass (Corning Inc., USA) can be adopted.

Note that, in the case of a liquid crystal display device, another layer insulating film is further provided so as to form either a transparent electrode in the case of a transmissive liquid crystal display device or a reflecting electrode in the case of a reflection-type liquid crystal display device.

The polycrystalline silicon thin film transistor can be formed at the temperature of not more than about 600° C. in the manufacturing process as shown in FIG. 8. Therefore, an ordinary glass substrate (whose point of deformation comes at not more than 600° C.) can be used without warp and flexure which may be caused by a process exceeding the point of deformation. Thus, an easy-to-mount and inexpensive large-area glass substrate can be adopted, thereby realizing an image display device having a larger area at lower cost.

In the foregoing structure, since the data signal line driving circuit SD, scanning signal line driving circuit GD and respective pixels PIX all include a switching element made up of the polycrystalline silicon thin film transistor, an element can be miniaturized, thereby increasing a display area with ease. Furthermore, the data signal line driving circuit SD, scanning signal line driving circuit GD and respective pixels PIX can readily be formed on the single substrate SUB, thereby saving manufacturing time and reducing a capacitance of each signal line. In addition, since the pre-charging circuit PC, scanning signal line driving circuit GD and data signal line driving circuit SD all include the switching element made of the polycrystalline thin film transistor, an element can be miniaturized, thus minimizing a circuit scale and reducing a frame size, and further, reducing power consumption because of the characteristic of the element.

As discussed, the image display device of the present invention includes:

a plurality of pixels disposed in a matrix;

a display section, having a plurality of data signal lines for respective columns of the plurality of pixels and having a plurality of scanning signal lines corresponding to respective rows of the plurality of pixels, for displaying an image by writing a video signal from each data signal line into each pixel in synchronism with a scanning signal which is outputted from each scanning signal line;

a data signal line driving circuit for outputting the video signal to the plurality of data signal lines;

a scanning signal line driving circuit for outputting the scanning signal to the plurality of scanning signal lines; and a pre-charging circuit for charging the plurality of data signal lines to a pre-charging voltage in a predetermined period of time in accordance with a pre-charging control signal, wherein a pre-charging voltage stabilizing section is provided on a preceding stage of the pre-charging circuit.

With this image display device, by including the pre-charging voltage stabilizing section, fluctuation in pre-charging voltage can be suppressed, and thus the data signal lines can be charged to a desired potential, and deterioration of image quality of the image display device can be suppressed. In addition, since the image display device does not require a current amplifying circuit, an increase of power consumption can be suppressed.

The pre-charging voltage stabilizing section is preferably made up of current controlling means and charge holding means. In this case, since the voltage (charge) supplied to the data signal line is held by the charge holding means, the charge can be supplied from the charge holding means while the pre-charging control signal is working. Further, the pre-charging voltage supplied from the control signal generating circuit may only be applied to the charge holding means while the pre-charging control signal is not working, and only a necessary amount of current is flown into the charge holding means by using the current controlling means. Thus, power consumption can be reduced.

The charge holding means is preferably composed of a capacitor. In this case, an optimum charge holding amount can be selected by thus composing the charge holding means by the capacitor.

The current controlling means is preferably composed of a resistor. In this case, an increase in consumed current can be suppressed by thus composing the current controlling means by the resistor.

It is preferable that the capacitance of the charge holding means is at least larger than the total capacitance of the plurality of data signal lines. In this case, the charge holding means is only required to supply a charge stored by the charge holding means while the pre-charging control signal is active, and it is not required to newly supply a charge from the control signal generating circuit, thereby suppressing the amount of currents and accordingly, power consumption.

When a pre-charging voltage is an AC voltage, time constants of the current controlling means and charge holding means making up the pre-charging voltage stabilizing section need only be shorter than the time between switching of the polarity of the pre-charging voltage and next activation of the pre-charge control signal.

In the case of an NTSC signal, a horizontal period (1H) is about 63 $\mu$sec, and a potential can be held sufficiently within this period. Namely, a charge can sufficiently be stored by the charge holding means before the pre-charging control signal comes into operation, and no charge needs to be newly supplied from the control signal generating circuit, thus suppressing the amount of currents, and accordingly, power consumption.

When the pre-charging voltage is the AC voltage, the time constants of the current controlling means and charge holding means making up the pre-charging voltage stabilizing section need only be shorter than the time between activation of the pre-charging control signal and the next activation thereof.

In this case, a charge can sufficiently be stored by the charge holding means before the pre-charging control signal comes into operation, and no charge needs to be newly supplied from the control signal generating circuit, thus suppressing the amount of currents, and accordingly, power consumption.

When the pre-charging voltage is the AC voltage, the current controlling means and charge holding means making up the pre-charging voltage stabilizing section preferably have such an optimum value as to stabilize the pre-charging voltage to a sufficient potential within a period of the pre-charging control signal.

In this case, the charges can sufficiently be stored by the charge holding means before the pre-charging control signal acts, and no voltages should newly be supplied from the control signal generating circuit, thus suppressing the amount of currents, and accordingly, power consumption.

When the pre-charging voltage is a DC voltage, the current controlling means and charge holding means making up the pre-charging voltage stabilizing section preferably have a value which is sufficient to stabilize the pre-charging voltage during a period from feeding power to starting display.

In this case, the potential can sufficiently be stored by the charge holding means before the pre-charging control signal comes into operation, and no charge needs to be newly supplied from the control signal generating circuit, thus suppressing the amount of currents, and accordingly, power consumption.

Further, when the pre-charging voltage is the DC voltage, the current controlling means and charge holding means making up the pre-charging voltage stabilizing section may have an optimum value by which more charges can be supplied than the charges supplied to the data signal lines by the pre-charging voltage from the pre-charging circuit within a period of the pre-charging control signal. Consequently, even if the pre-charging voltage decreases, for example, when the pre-charging control signal rises (when being active), i.e. while supplying the data signal lines with a charge, it is only required that the pre-charging voltage returns afterwards to the optimum value within a period of pre-charging control signal. Thus, the data signal lines can be charged to the pre-charging voltage, thereby suppressing impairment of image quality in the image display device.

As discussed, a driving method of the image display device according to the present invention includes:

a plurality of pixels disposed in a matrix;

a display section having a plurality of data signal lines for respective columns of the plurality of pixels and having a plurality of scanning signal lines corresponding to respective rows of the plurality of pixels, the display section for displaying an image by writing a video signal from each data signal line into each pixel in synchronism with a scanning signal which is outputted from each scanning signal line;

a data signal line driving circuit for outputting the video signal to the plurality of data signal lines;

a scanning signal line driving circuit for outputting the scanning signal to the plurality of scanning signal lines; and a pre-charging circuit for charging the plurality of data signal lines to a pre-charging voltage in a predetermined period of time in accordance with a pre-charging control signal, wherein the pre-charging voltage which is inputted to a pre-charging voltage stabilizing section which is made up of current controlling means and charge holding means and is provided on a preceding stage of the pre-charging circuit has an AC voltage in synchronism with one horizontal period of the video signal.

With the foregoing driving method, when the video signal is in the state of positive or negative polarity, by making the pre-charging voltage to have the AC voltage in synchronism with the polarity change, it is possible to (a) charge the data signal line with an optimum pre-charging voltage, (b) suppress fluctuation in the pre-charging voltage, and (c) charge the data signal lines with a desired voltage, thereby suppressing deterioration of image quality of the image display device.

The pre-charging voltage preferably is a voltage with a polarity opposite to that of the video signal. In this case, for example, while writing the video signal of a negative polarity from the data signal line driving circuit into the data signal lines, the pre-charging voltage has a positive polarity which is opposite to the negative polarity of the video signal, and a charge holding a positive potential is accumulated in the charge holding means of the pre-charging voltage stabilizing section. While sufficiently storing the charge in the charge holding means, the video signal having a negative polarity is written into the pixels by the data signal line driving circuit and scanning signal line driving circuit, and after the pixel capacitor is disconnected from the data signal line by the switching element of the pixel, a pre-charge from the pre-charging circuit can be written into the data signal lines, the pre-charge having the same positive polarity as that of the video signal to be sampled in the next one horizontal period and having been stored by the charge holding means of the pre-charging voltage stabilizing section. By this driving method, fluctuation in the pre-charging voltage can be suppressed, and the data signal lines can be charged to a desired voltage, thereby suppressing deterioration of image quality in the image display device.

The pre-charging voltage is preferably an AC voltage which is equipotential from maximum amplification values of positive and negative polarities of the video signal, respectively. In this case, the optimum value of the pre-charging voltage can arbitrarily be selected, and the data signal lines can be charged to a desired voltage, thereby suppressing deterioration of image quality in the image display device.

As discussed, a driving method of the image display device according to the present invention includes:

a plurality of pixels disposed in a matrix;

a display section having a plurality of data signal lines for respective columns of the plurality of pixels and having a plurality of scanning signal lines corresponding to respective rows of the plurality of pixels, the display section for displaying an image by writing a video signal from each data signal line into each pixel in synchronism with a scanning signal which is outputted from each scanning signal line;

a data signal line driving circuit for outputting the video signal to the plurality of data signal lines;

a scanning signal line driving circuit for outputting the scanning signal to the plurality of scanning signal lines; and a pre-charging circuit for charging the plurality of data signal lines to a pre-charging voltage in a predetermined period of time in accordance with a pre-charging control signal, wherein the pre-charging voltage which is inputted to a pre-charging voltage stabilizing section which is made up of current controlling means and charge holding means and is provided on a preceding stage of the pre-charging circuit has an AC voltage.

In the foregoing driving method, since the pre-charging voltage is the DC voltage, the data signal lines can be charged to the optimum pre-charging voltage, and fluctuation in the pre-charging voltage can be suppressed, and the data signal lines can be charged to a desired voltage, thereby suppressing deterioration of image quality in the image display device.

The pre-charging voltage is preferably an AC voltage which is equipotential from maximum amplification values of positive and negative polarities of the video signal, respectively.

In this case, the data signal lines can be charged to the optimum pre-charging voltage, and fluctuation in the pre-charging voltage can be suppressed, and the data signal lines can be charged to a desired voltage, thereby suppressing deterioration of image quality in the image display device. Further, in this case, even in the case of a driving method in which a counter voltage has the AC voltage, fluctuation in the pre-charging voltage can be suppressed, and the data signal lines can be charged to a desired voltage, thereby suppressing deterioration of image quality in the image display device.

Here, the following will explain a driving method for an image display device having a non-match image display mode for displaying a video picture having an aspect ratio different from an aspect ratio of a screen of a display device, and the image display device.

Note that, this is applicable to both an image display device for displaying an image having an aspect ratio of 16:9 on a screen having an aspect ratio of 4:3, and an image display device for displaying an image of the aspect ratio 4:3 on a screen of the aspect ratio 16:9; however, for ease of explanation, the former will be explained as an example with reference to drawings attached hereto.

Figure 12:
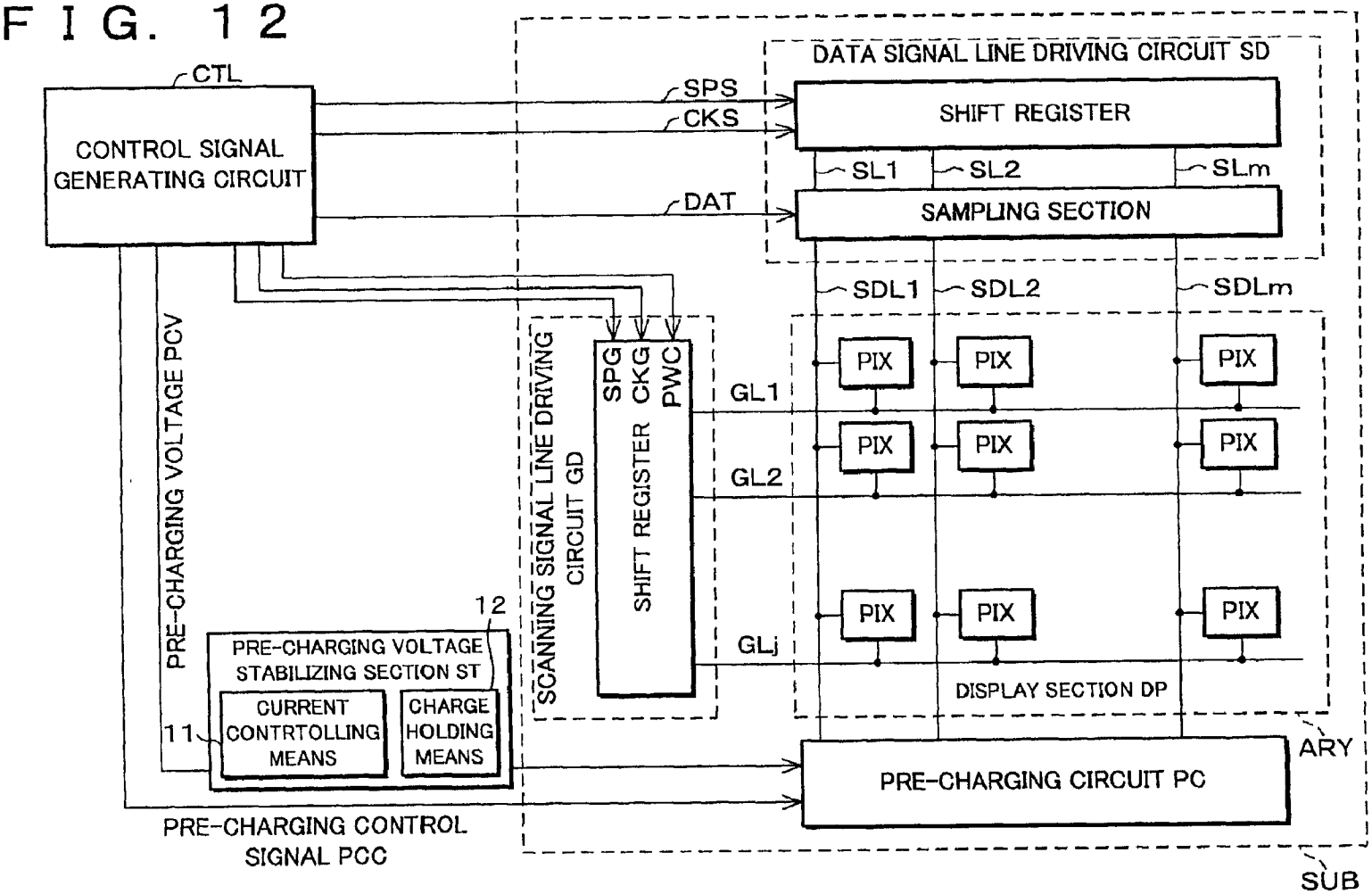
FIG. 12 is a block diagram showing an example of a structure of image display devices according to Third to Fifth Embodiments of the present invention.

FIG. 12 is a block diagram showing a structure of an image display device. In the present Embodiment, explanation will be made through the case where 27 lines each of black areas are respectively provided in upper and lower parts of a screen. Note that, the present Embodiment adopts a driving method called 1H reversal driving by which a video signal DAT to be written into a pixel PIX is switched between positive and negative for every horizontal period.

Here, a Third Embodiment of the present invention will be explained. The image display device shown in FIG. 12 is made up of a data signal line driving circuit SD, a scanning signal line driving circuit GD, a pixel array ARY, a control signal generating circuit CTL, a pre-charging circuit PC, and a pre-charging voltage stabilizing circuit ST, wherein each pixel PIX which forms the pixel array ARY is connected with a data signal line SDLi (i=1 to m) and a scanning signal line GLj (j=1 to n), respectively. Further, as discussed later, the pixel PIX, the data signal line driving circuit SD, the scanning signal line driving circuit GD and the pre-charging circuit PC are formed on a single substrate SUB.

Figure 15:
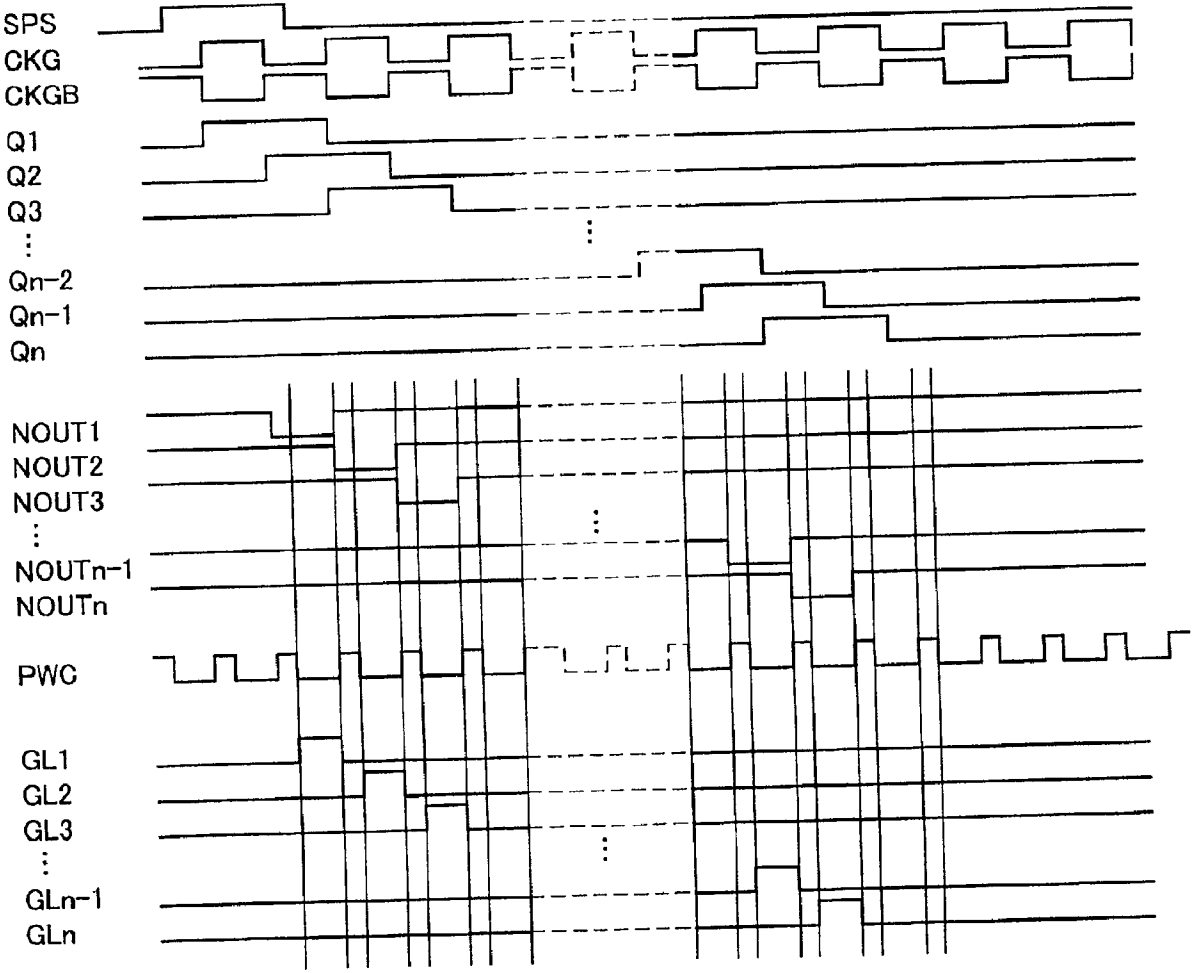
FIG. 15 is a timing chart in a normal mode of a scanning signal line driving circuit adopted in a driving method for the image display device of the present invention.
Figure 16:
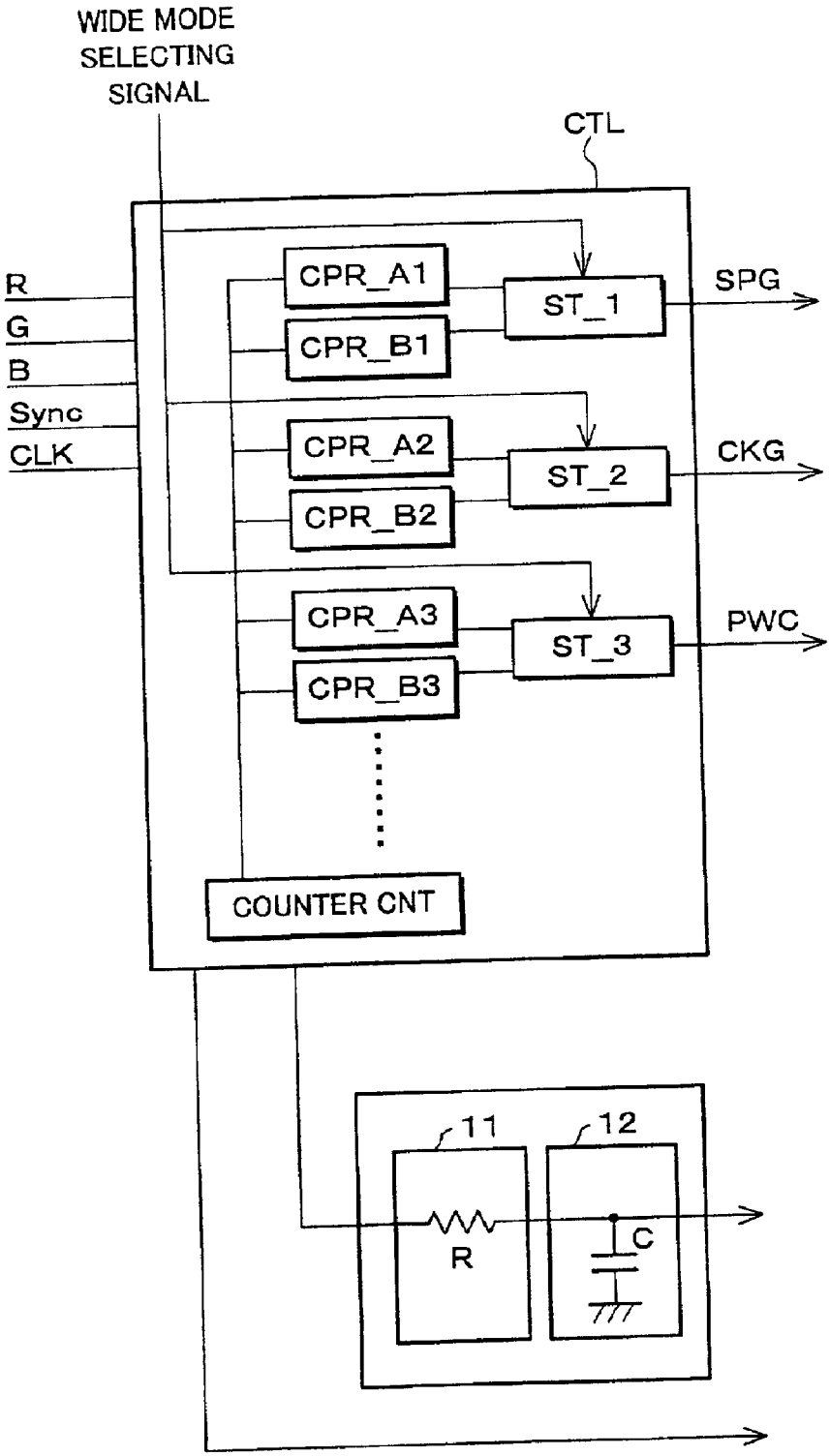
FIG. 16 is a block diagram showing a structure of a main portion of a control signal generating circuit and a pre-charging voltage stabilizing circuit.

As shown in FIG. 16, the control signal generating circuit CTL includes a counter CNT for counting a reference clock (CLK), a plurality of pairs of comparators CPR in which a timing of normal display and a timing in a wide mode are respectively set, and a selector ST for selecting output of the plurality of comparators. This control signal generating circuit CTL receives various signals including color signals (R, G and B), a synchronization signal (Sync), a reference clock signal (CLK) and a wide mode selecting signal, so as to output each control signal in accordance with a timing chart shown in FIG. 14 when displaying in the wide mode, and when not displaying in the wide mode, that is, in the case of normal display for displaying a picture of an image aspect ratio 4:3 on a screen of an aspect ratio 4:3, each control signal is outputted according to a timing chart shown in FIG. 15. In the control signal generating circuit CTL, when, for example, focusing on a scanning start signal SPG, there are provided a comparator CPR_A1 in which the timing of the normal display is programmed and a comparator CPR_B1 in which the timing in the wide mode is programmed. Therefore, when the wide mode selecting signal is inputted from the outside, the selector ST1 selects the comparator CPR_B1, or in the case of the normal display, the selector ST1 selects the comparator CPR_A1, thereby controlling the scanning start signal SPG at each timing shown in FIG. 14 or 15. Likewise, the other signals CKG and PWC are either suspended or outputted at the timing shown in FIG. 14 or 15.

Figure 13:
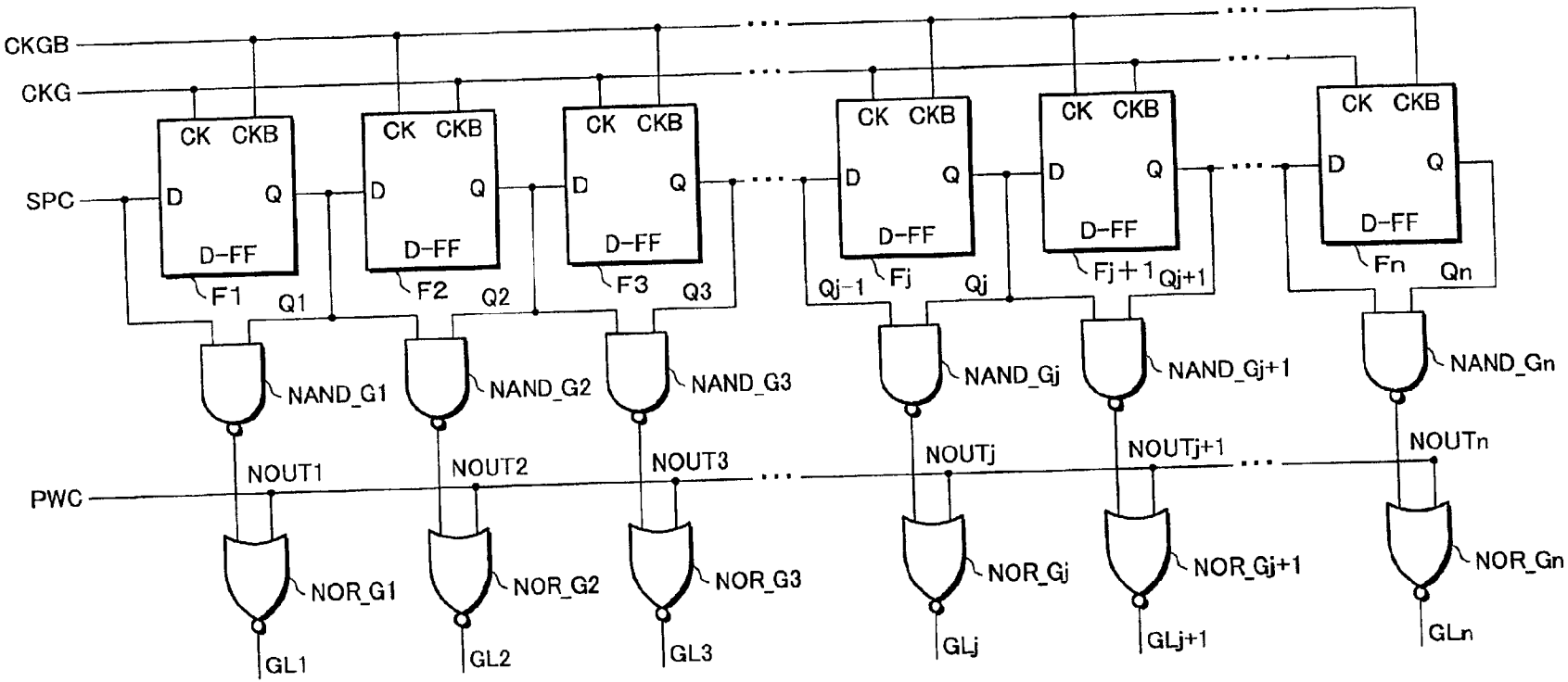
FIG. 13 is a timing chart according to the image display device of the Third Embodiment of the present invention.

The scanning signal line driving circuit GD, as shown in FIG. 13, is made up of a shift register SR including a plurality of flip-flops F1 to Fn, NAND elements NAND_G1 to NAND_Gn which are each a NAND of adjacent outputs of the flip-flops F1 to Fn, and NOR elements NOR_G1 to NOR_Gn which are each a NOR of the output of each of the NAND elements NAND_G1 to NAND_Gn and a pulse width control signal PWC which is inputted to control the pulse width of a scanning signal, wherein a scanning signal is outputted to each scanning signal line GLj upon receipt of a scanning start signal from the control signal generating circuit CTL, and a pulse width control signal which controls a successive output signal and a signal width of the successive output signal.

Further, the pre-charging voltage stabilizing circuit ST, as shown in FIG. 12, is made up of current controlling means 11 and charge holding means 12, wherein the charge holding means 12 is charged to a pre-charging voltage PCV from the control signal generating circuit CTL so as to output a signal voltage which is the equivalent of a video signal DAT for black display. In the present Embodiment, as shown in FIG. 16, the charge holding means 12 is made up of a capacitor C, and, for the power-saving purpose, the current controlling means 11 is made up of a resistor R.

The capacity of the capacitor C (capacitance) of the charge holding means is required to be at least larger than the total capacity of all the data signal lines SDLi. More specifically, while the pre-charging control signal PCC is active, only the charge stored in the charge holding means 12 is required to be supplied, and it is not necessary to newly supply a charge from the control signal generating circuit CTL, thereby suppressing the amount of currents and hence power consumption. In addition, the resistor R that is the current controlling means 11 suppresses a current (inrush current in particular) flowing from the control signal generating circuit CTL, and power fluctuation which may occur in the control signal generating circuit CTL can be suppressed.

When the pre-charging voltage PCV is an AC voltage, the current controlling means 11 and charge holding means 12, which make up the pre-charging voltage stabilizing circuit ST, are to have such an optimum value as to stabilize the pre-charging voltage PCV to a sufficient potential within a period of the pre-charging control signal PCC. For example, in the case of an NTSC signal, a horizontal period (1H) is about 63.5 $\mu$s, and a potential can be held sufficiently within this period. Namely, the capacitor C and the resistor R are set to have values so that a charge can sufficiently be stored by the charge holding means before the pre-charging control signal PCC comes into operation. Here, in the pre-charging voltage stabilizing section ST, the capacitor C is 10 nF, and the resister R is 220 Ω. With this arrangement, it is possible to store charges sufficiently in the charge holding means before the pre-charging control signal PCC comes into operation, and no charge needs to be newly supplied from the control signal generating circuit CTL, thus suppressing the amount of currents and hence power consumption. Note that, the current controlling means 11 and the charge holding means 12, which make up the pre-charging voltage stabilizing circuit ST, may adopt other electronic devices insofar as they satisfy the foregoing conditions.

Figure 14:
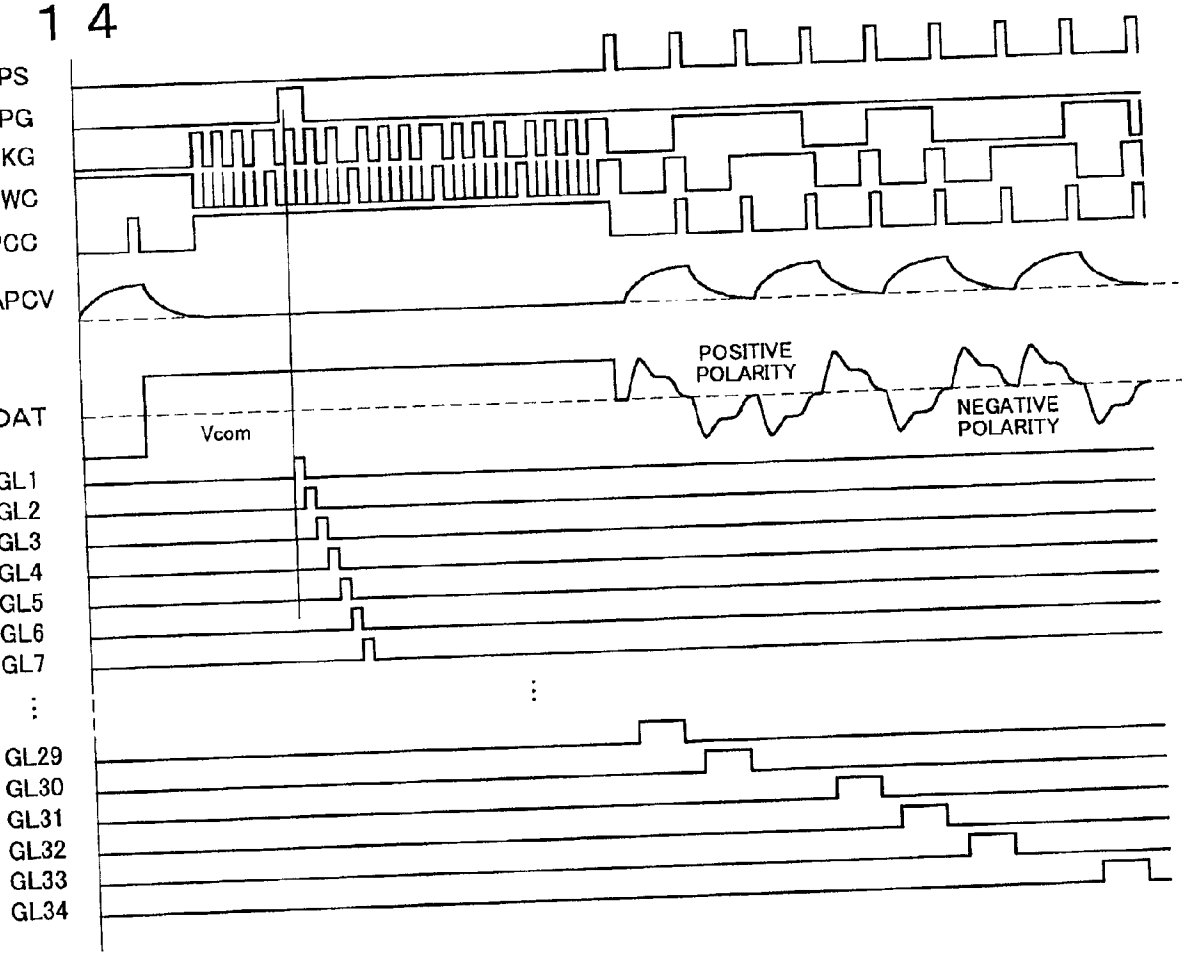
FIG. 14 is a timing chart in the case of display in a wide mode according to a driving method for the image display device of the present invention.

Next, the following will explain operations of the components with reference to a timing chart of FIG. 14. In the wide mode, as explained in the Background of the Invention, within the vertical retrace line period, a voltage which is the equivalent of a voltage required for black display is supplied from the pre-charging circuit PC to the data signal line SDLi. In that case, the pre-charging voltage PCV from the control signal generating section CTL is gradually applied to the capacitor C of the pre-charging voltage stabilizing circuit ST during the horizontal period of 63.5 $\mu$s. When an output voltage APCV of the pre-charging voltage stabilizing circuit ST reaches a voltage which is the equivalent of a voltage of a video signal required for black display, the pre-charging control signal PCC becomes effective over the pre-charging circuit PC, then all the data signal lines SDLi are charged to the pre-charging voltage APCV altogether. Concurrently, supply of the scanning start signal SPG to the scanning signal line driving circuit GD is suspended so as to stop the scanning signal. Here, the data signal line driving circuit SD is not supplied with the control signals SPS and CKS, thereby stopping operations.

Next, after the pre-charging voltage PCV becomes sufficiently stable, the scanning signal line driving circuit GD is supplied with the scanning start signal SPG, then, the scanning signal line driving circuit GD outputs the scanning signal to the scanning signal lines GLj, thereby opening the switching element SW which forms a pixel PIX connected to each scanning signal line GLj, and writing a voltage which is the equivalent of the voltage required for black display supplied from the pre-charging circuit PC into the pixel. Finishing writing into the pixel of the black display area, the data signal line driving circuit SD that has been suspended restarts to receive the control signal SPS and the video signal DAT, thus starting display of an image.

Figure 17:
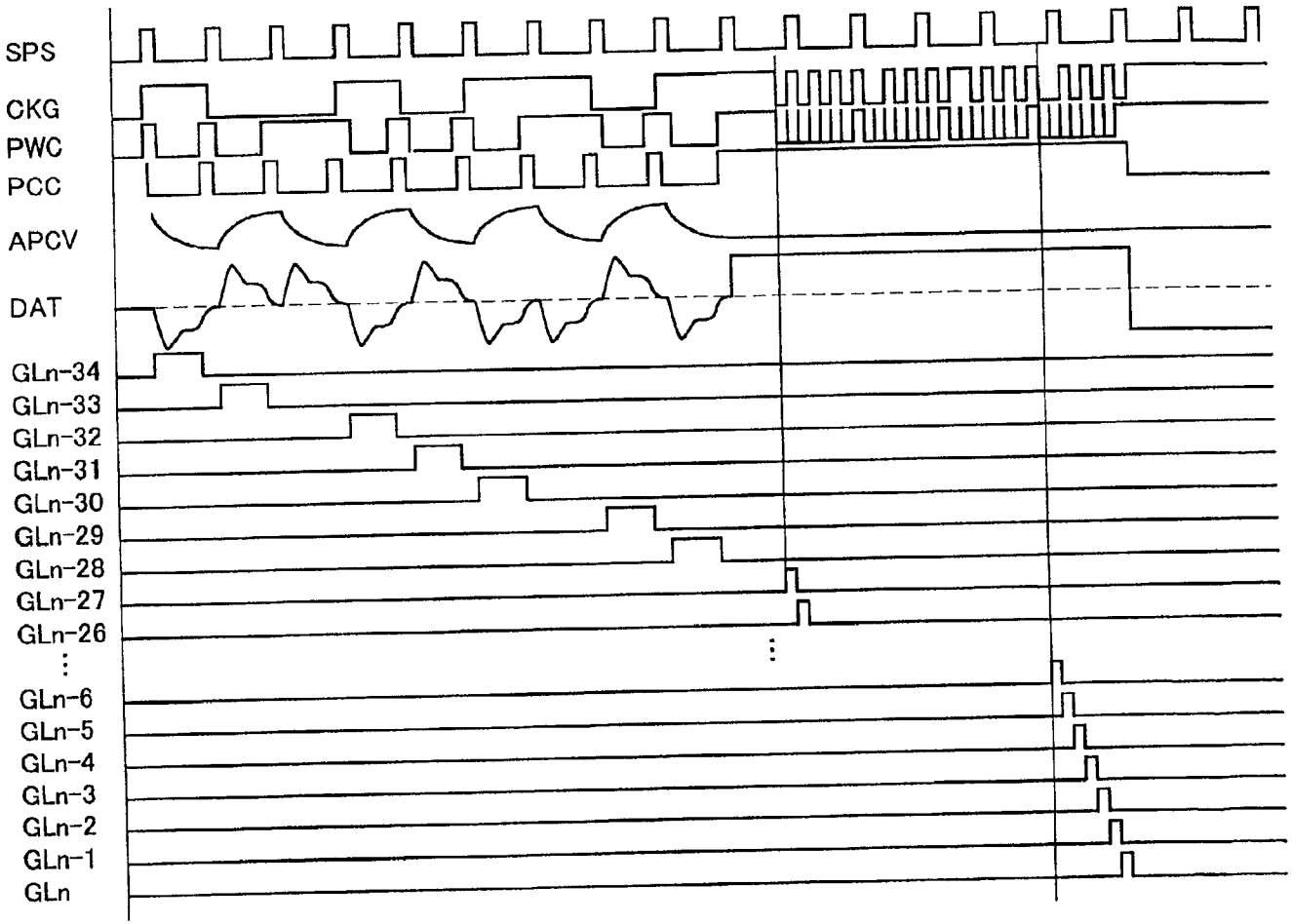
FIG. 17 is a timing chart in the case of performing black display in a lower part of a screen according to the Third Embodiment.

Finishing display of an image and entering the vertical retrace line period of the video signal DAT, black display starts in the lower part of a screen. FIG. 17 will show a timing chart in that case. In the case of the lower part of the screen, output from a flip-flop Fn-27 is inputted to a flip-flop Fn-26, the flip-flop Fn-27 forming the shift register SR within the scanning signal line driving circuit GD that generated a scanning signal of a scanning signal line GLj-27 which is a line immediately before a scanning signal line GLj-26 connected to the pixel PIX to perform black display, and the scanning timing signal CKG remains suspended until the capacitor C of the pre-charging voltage stabilizing circuit ST is supplied with a pre-charging voltage PCV so as to be sufficiently charged.

After the pre-charging voltage PCV becomes sufficiently stable, the scanning signal line driving circuit GD is replaced under the effect of the scanning timing signal CKG, thereafter outputting a scanning signal to the scanning signal line GLj, and successively, the switching element forming the pixel PIX connected to each scanning signal line is opened, thereby writing a voltage required for black display supplied from the pre-charging circuit PC into the pixel.

As discussed, when performing black display in the upper black display area in the upper part of the screen and in the lower black display area in the lower part of the screen by the pre-charging voltage which is the equivalent of the voltage required for black display of the video signal inputted from the pre-charging circuit, suspending a scanning signal for a predetermined period of time allows the pixel to be charged to a voltage of a potential required for black display after sufficiently charging the charge holding means of the pre-charging voltage stabilizing circuit, thereby, in the area to display the video signal, suppressing fluctuation in the pre-charging voltage while charging a data signal line to a desired voltage, thus performing preferable wide-mode display in a liquid crystal display device having the pre-charging voltage stabilizing circuit ST the aim of which is to save power. In addition, since a current amplifying circuit is not required, an increase in power consumption can be suppressed.

Figure 18:
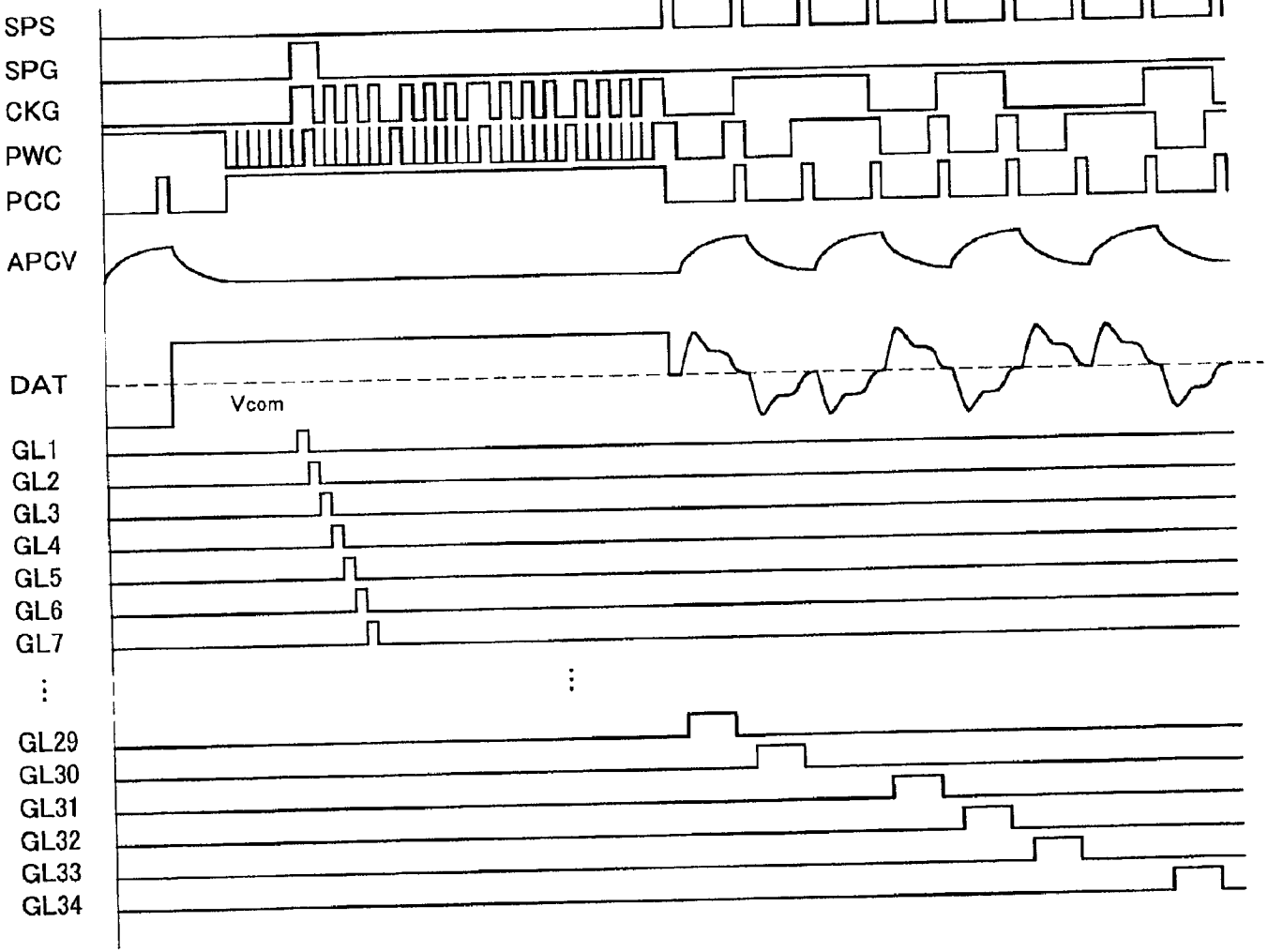
FIG. 18 is a timing chart according to the image display device of the Fourth Embodiment of the present invention.

Here, the following will explain a Fourth Embodiment of the present invention. The Fourth Embodiment is the same as the Third Embodiment in terms of the arrangements of a data signal line driving circuit SD, a scanning signal line driving circuit GD, a pixel array ARY, a pre-charging circuit PC and a pre-charging voltage stabilizing circuit ST, except that, unlike the Third Embodiment, when performing black display in the upper part of a screen, a scanning timing signal CKG, as with a scanning start signal SPG, is set to be suspended for a predetermined period of time until a pre-charging voltage APCV becomes sufficiently stable in the pre-charging voltage stabilizing circuit ST. FIG. 18 will show a timing chart thereof.

This enables a pixel to be charged to a voltage which is the equivalent of a voltage required for black display after finishing storage of sufficient charges in charge holding means of the pre-charging voltage stabilizing circuit, thereby, in an area to display a video signal, suppressing fluctuation in the pre-charging voltage while charging a data signal line to a desired voltage, thus performing preferable wide-mode display.

Figure 19:
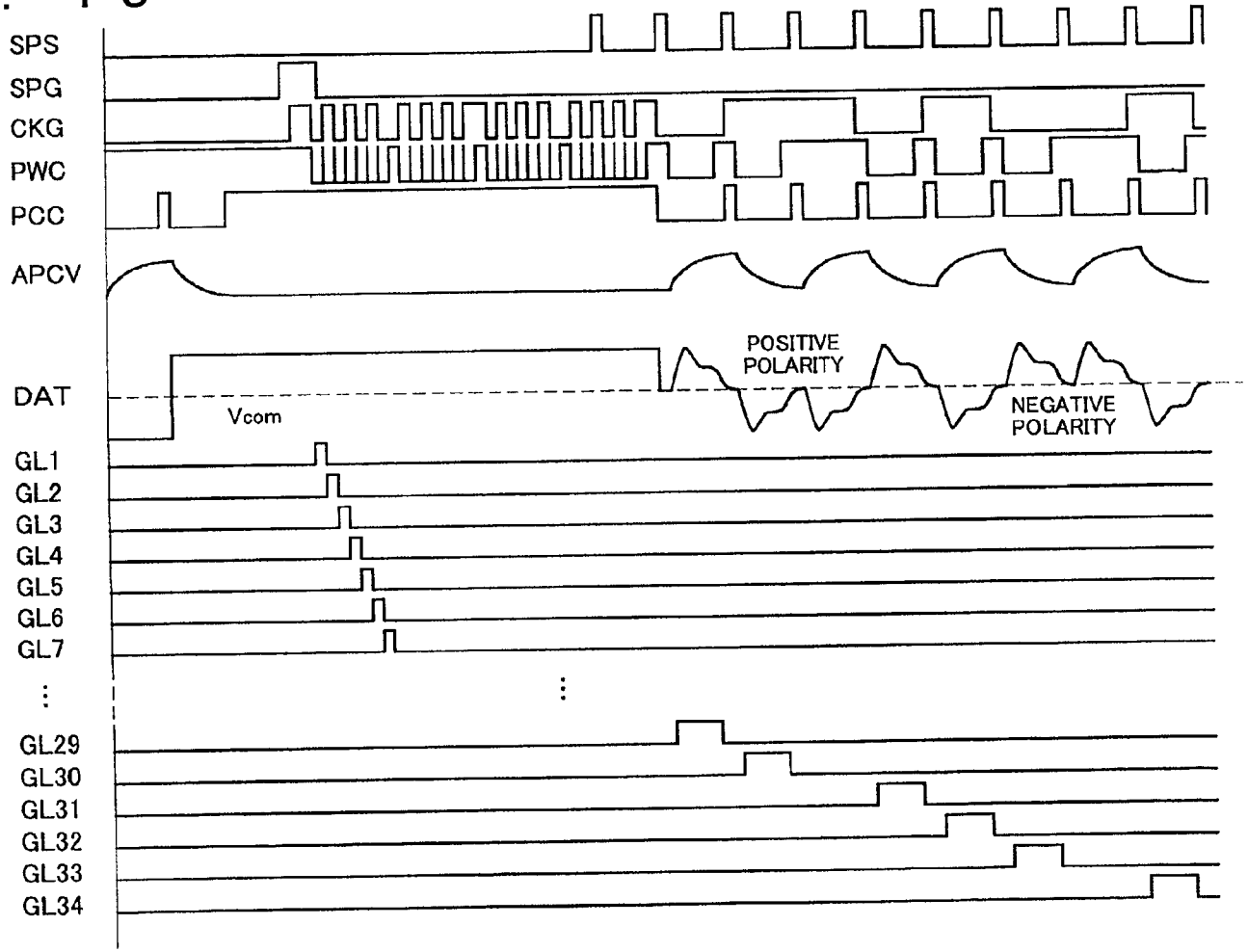
FIG. 19 is a timing chart according to the image display device of the Fifth Embodiment of the present invention.

Here, the following will explain a Fifth Embodiment of the present invention. The Fifth Embodiment is the same as the Third Embodiment in terms of the arrangements of a data signal line driving circuit SD, a scanning signal line driving circuit GD, a pixel array ARY, a pre-charging circuit PC and a pre-charging voltage stabilizing circuit ST, except that, unlike the Third and Fourth Embodiments in which a scanning start signal SPG and a scanning timing signal CKG are suspended until a pre-charging voltage PCV becomes sufficiently stable in the pre-charging voltage stabilizing circuit ST, as shown in a timing chart of FIG. 19, a control signal generating circuit CTL stops a pulse width control signal PWC as with the scanning start signal SPG and the scanning timing signal CKG.

FIG. 15 has shown a timing chart of the operation of the scanning signal line driving circuit GD in the Third Embodiment, where a scanning signal can be outputted only when the pulse width control signal PWC is active. Therefore, by suspending the pulse width control signal PWC as with the present Embodiment can be attained the same effects of the Third and Fourth Embodiments, thereby performing preferable wide-mode display even in a liquid crystal display device having the pre-charging voltage stabilizing circuit ST for saving power.

The foregoing explanation has been made through the case where scanning signal lines are successively scanned; however, the present invention is not limited to this. For example, a plurality of scanning signal lines corresponding to a black display area may simultaneously be scanned. Alternatively, all the scanning signal lines corresponding to the black display area may simultaneously be scanned. Furthermore, at the same time, scanning signal lines corresponding to the upper black display area and the lower black display area, respectively, may successively be scanned. This enables the effective use of the vertical retrace line period, thereby securing the write time.

Next, the following will explain a physical structure of the image display device adopted in the Third, Fourth and Fifth Embodiments. This image display device, as shown in FIG. 12, has a driver monolithic structure in which a pixel PIX, a data signal line driving circuit SD, a scanning signal line driving circuit GD and a pre-charging circuit PC are formed on a single substrate SUB, where the pre-charging voltage circuit PC, the data signal line driving circuit SD and the scanning signal line driving circuit GD are individually disposed so that they are widely dispersed in an area having substantially the same length as that of a screen (display section) having a pixel array ARY. Further, a control signal generating circuit CTL and the pre-charging voltage stabilizing circuit ST are externally provided and connected to each circuit with a signal line.

Figure 20:
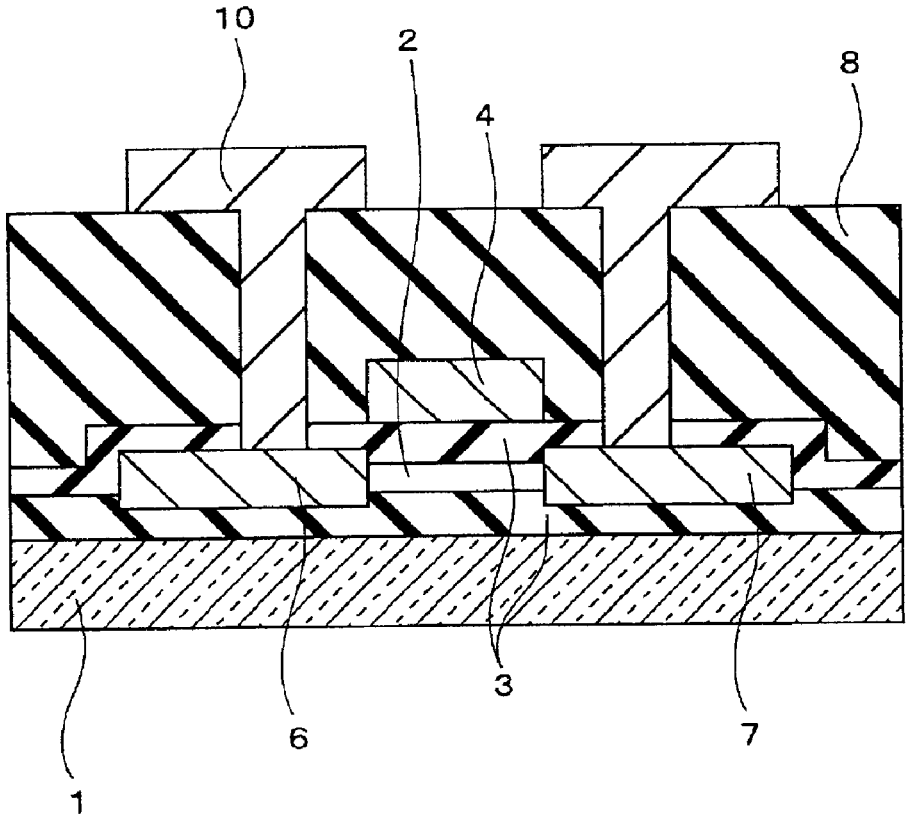
FIG. 20 is an explanatory view showing a structure of a polycrystalline thin film transistor which forms the image display device of the present invention.
Figure 21:
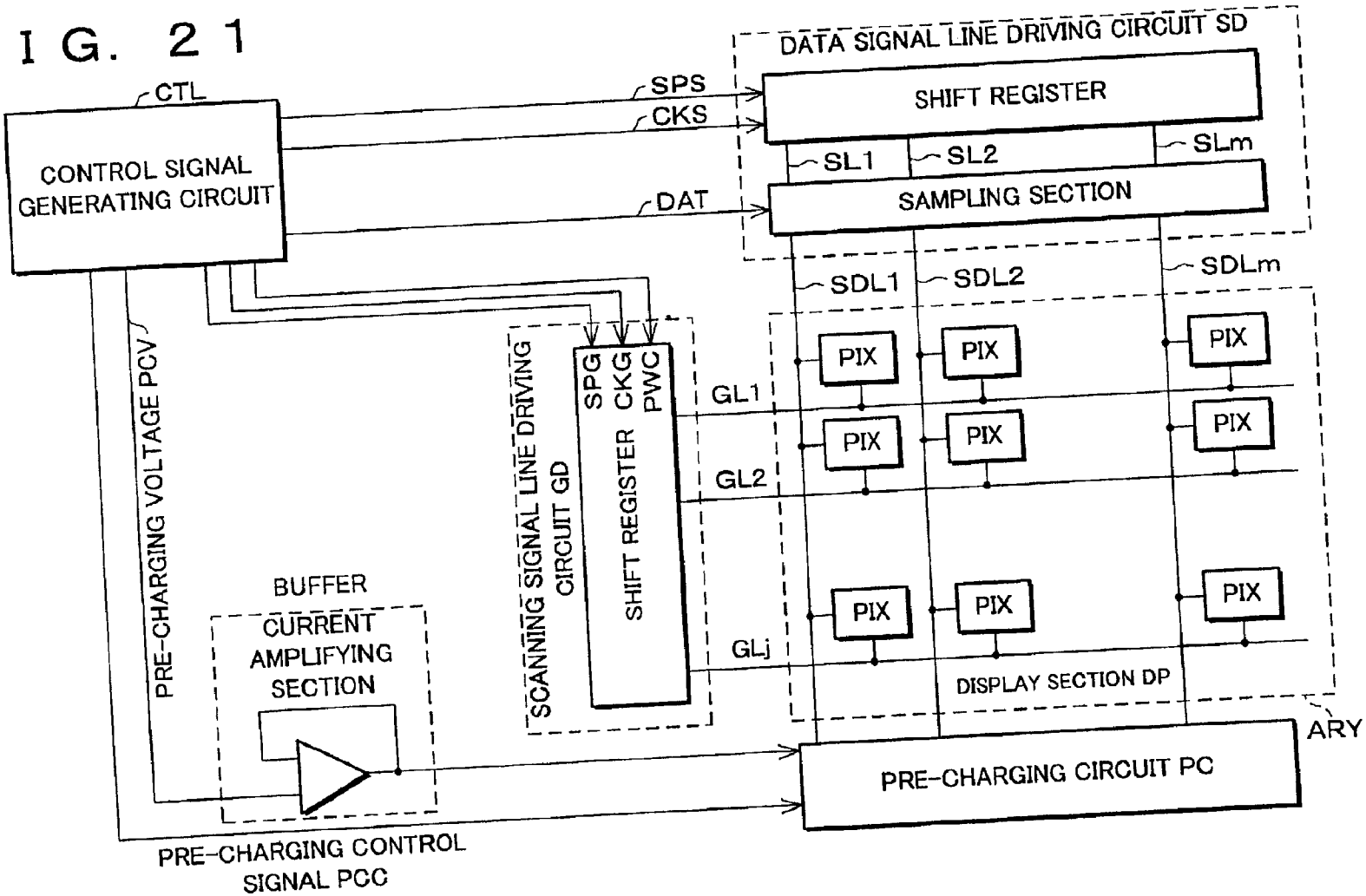
FIG. 21 is a block diagram showing a structure of an image display device according to prior art.
Figure 22:
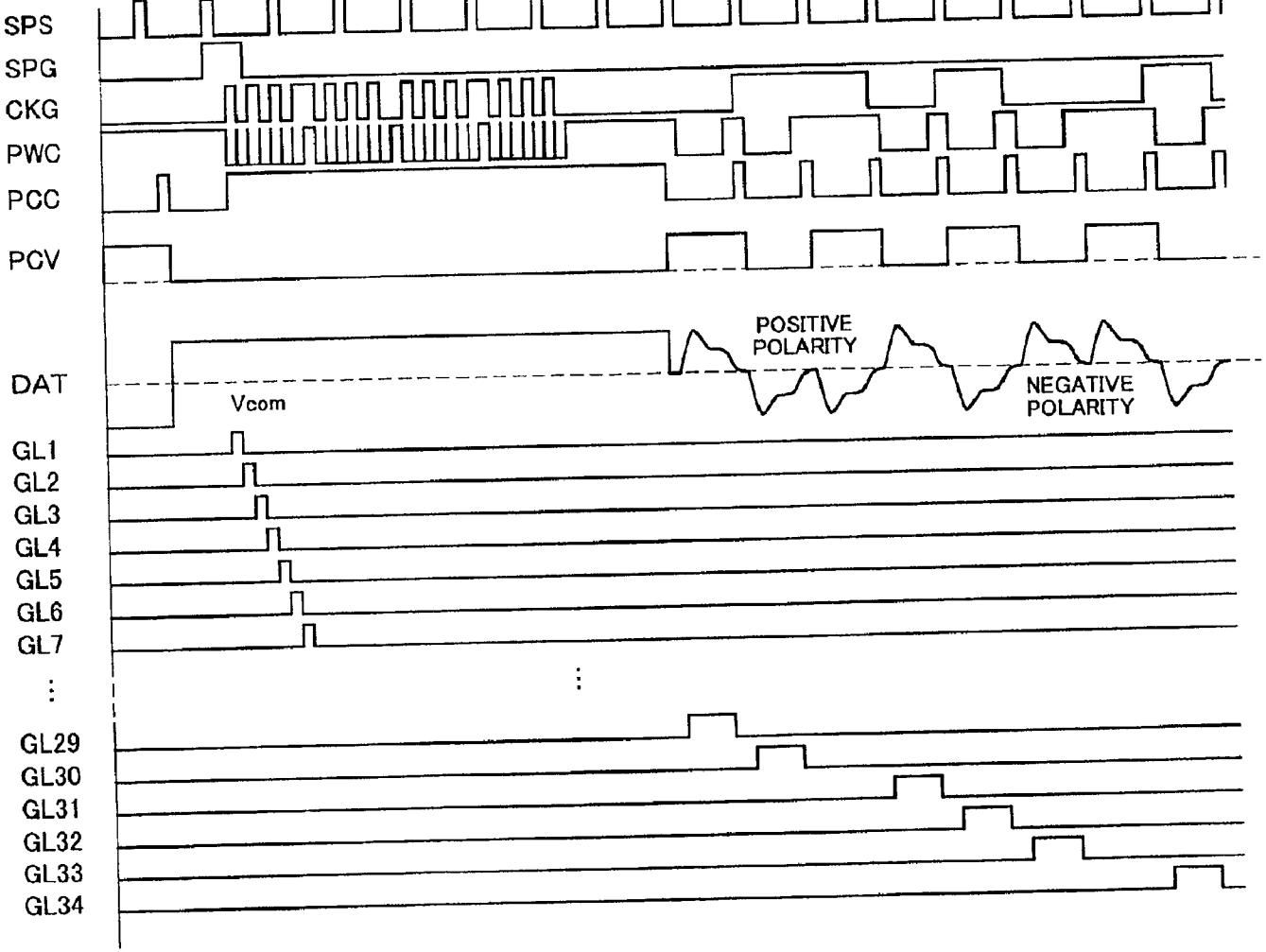
FIG. 22 is a waveform diagram showing driving waveforms in the case of performing black display in an upper part of a screen in an image display device according to prior art.
Figure 23:
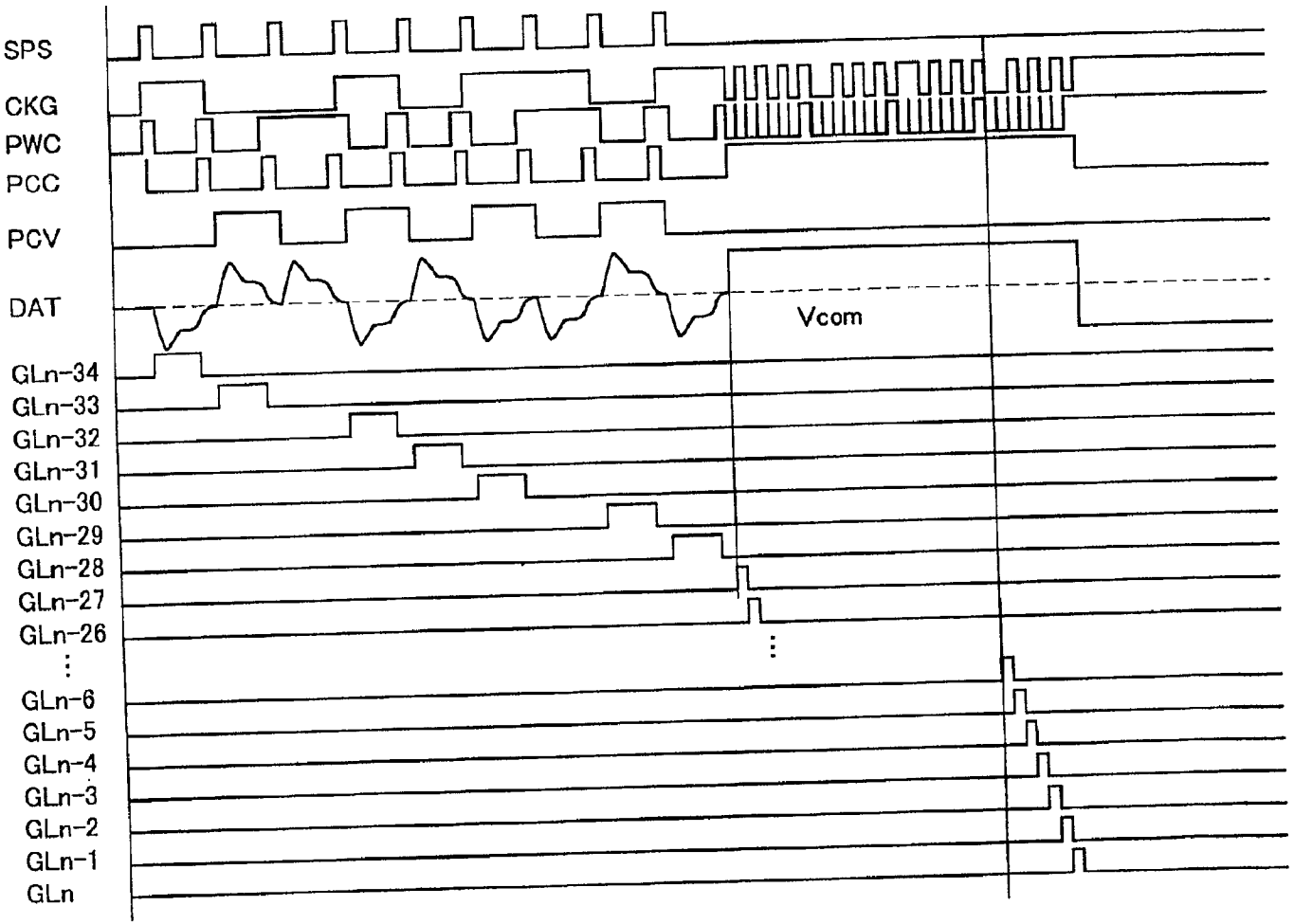
FIG. 23 is a waveform diagram showing driving waveforms in the case of performing black display in a lower part of a screen in an image display device of prior art.
Figure 24:
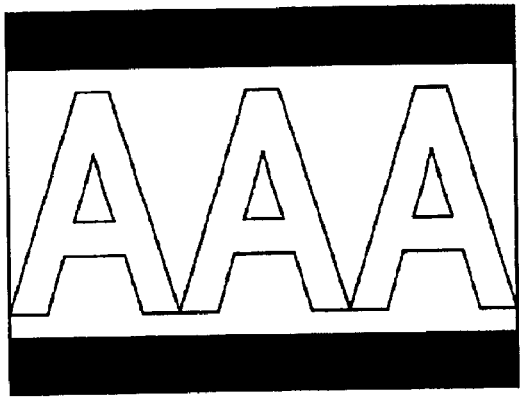
FIG. 24 is an explanatory view showing the case where black display is performed in upper and lower parts of a screen, and an image display device having an aspect ratio of 4:3 displays an image of an aspect ratio 16:9.
Figure 25:
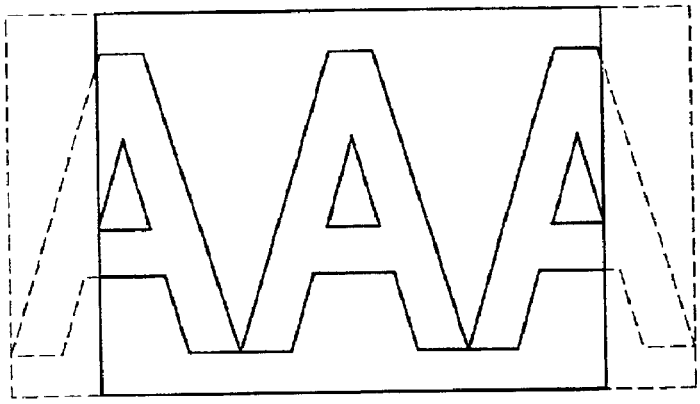
FIG. 25 is an explanatory view showing the case where a screen is cut on both sides, and an image display device having an aspect ratio of 4:3 displays an image of an aspect ratio 16:9.

Each circuit is made up of, for example, a polycrystalline silicon thin film transistor shown in FIG. 20. The polycrystalline silicon thin film transistor as illustrated has a forward staggered (top gate) structure in which a polycrystalline silicon thin film on an insulating substrate 1 is an activated layer 2; however, the present invention is not limited to this, but other structures such as a reverse staggered structure may be adopted as well.

As discussed, the polycrystalline silicon thin film transistor of the foregoing structure can be manufactured, for example, by a manufacturing method including the steps shown in FIGS. 8(*a*) through 8(*k*).

As is clear from the foregoing explanation, in the present invention, a driving method of an image display device having pre-charging voltage stabilizing means, which includes charge holding means and current controlling means, on a preceding stage of a pre-charging circuit has an arrangement in which, when performing black display in an upper black display area of an upper part of a screen and in a lower black display area of a lower part of the screen by a pre-charging voltage which is the equivalent of a voltage required for black display of a video signal inputted from the pre-charging circuit, a scanning signal is suspended for a predetermined period of time, thereby enabling a pixel to be charged to a voltage of a potential required for black display after finishing storage of sufficient charges in charge holding means of a pre-charging voltage stabilizing circuit, and in an area to display a video signal is suppressed fluctuation in the pre-charging voltage while charging a data signal line to a desired voltage, thus suppressing impairment of an image quality of the image display device. Moreover, since no current amplifying circuit is required, an increase in power consumption can be suppressed.

Further, in a driving method of an image display device according to the present invention, when performing black display in a black display area of an upper part of a screen by a pre-charging voltage of a potential required for black display of a video signal inputted from a pre-charging circuit, in order to suspend a scanning signal, input of a scanning start signal is suspended for the predetermined period of time, thereby charging a pixel to a potential required for black display after finishing storage of sufficient charges in charge holding means of a pre-charging voltage stabilizing circuit, and in an area to display a video signal is suppressed fluctuation in the pre-charging voltage while charging a data signal line to a desired voltage, thus suppressing impairment of an image quality of the image display device. Moreover, since no current amplifying circuit is required, an increase in power consumption can be suppressed.

Further, in a driving method of an image display device according to the present invention, when performing black display in a black display area of an upper part of a screen by a pre-charging voltage of a potential required for black display of a video signal inputted from a pre-charging circuit, in order to suspend a scanning signal, input of a scanning start signal and a scanning timing signal are suspended for a predetermined period of time, thereby enabling a pixel to be charged to a voltage of a potential required for black display after finishing storage of sufficient charges in charge holding means of a pre-charging voltage stabilizing circuit, and in an area to display a video signal is suppressed fluctuation in the pre-charging voltage while charging a data signal line to a desired voltage, thus suppressing impairment of an image quality of the image display device. Moreover, since no current amplifying circuit is required, an increase in power consumption can be suppressed.

Further, in a driving method of an image display device according to the present invention, when performing black display in a black display area of a lower part of a screen by a pre-charging voltage of a potential required for black display of a video signal inputted from a pre-charging circuit, in order to suspend a scanning signal, input of a scanning timing signal and a pulse width control signal are suspended for a predetermined period of time, thereby enabling a pixel to be charged to a voltage of a potential required for black display after finishing storage of sufficient charges in charge holding means of a pre-charging voltage stabilizing circuit, and in an area to display a video signal is suppressed fluctuation in the pre-charging voltage while charging a data signal line to a desired voltage, thus suppressing impairment of an image quality of the image display device. Moreover, since no current amplifying circuit is required, an increase in power consumption can be suppressed.

Further, in a driving method of an image display device according to the present invention, by setting a predetermined period of time for suspending a scanning start signal, a scanning timing signal and a pulse width control signal to be not less than a time constant of current controlling means and charge holding means which form a pre-charging voltage stabilizing circuit, it is possible to sufficiently store a voltage of a potential required for black display of a video signal in charge holding means of a pre-charging voltage stabilizing circuit. This enables a pixel to be charged to a voltage of a potential required for black display after finishing storage of sufficient charges in the charge holding means of the pre-charging voltage stabilizing circuit, and in an area to display a video signal is suppressed fluctuation in the pre-charging voltage while charging a data signal to a desired voltage, thus suppressing impairment of an image quality of the image display device. Moreover, since no current amplifying circuit is required, an increase in power consumption can be suppressed.

Further, in a driving method of an image display device according to the present invention, by setting the predetermined period of time at the time required for sufficiently stabilizing the pre-charging voltage or more, it is possible to sufficiently store a voltage of a potential required for black display of a video signal in charge holding means of a pre-charging voltage stabilizing circuit. This enables a pixel to be charged to a voltage of a potential required for black display after finishing storage of sufficient charges in the charge holding means of the pre-charging voltage stabilizing circuit, and in an area to display a video signal is suppressed fluctuation in the pre-charging voltage while charging a data signal line to a desired voltage, thus suppressing impairment of an image quality of the image display device. Moreover, since no amplifying circuit is required, an increase in power consumption can be suppressed.

Further, since a switching element making up the pre-charging circuit PC, the data signal line driving circuit SD, the scanning signal line driving circuit GD and the pixel is formed with a polycrystalline silicon thin film, each circuit can be manufactured at a temperature of not more than about 600° C. Therefore, an ordinary glass substrate (whose point of deformation comes at not more than 600° C.) can be used, thereby attaining an image display device having a larger area at lower cost.

Moreover, the use of a polycrystalline silicon thin film transistor enables an arrangement in which the pre-charging circuit PC capable of practical driving performance, the data signal line driving circuit SD and the scanning signal line driving circuit GD are formed on a single substrate having a pixel PIX through substantially the same manufacturing process. Accordingly, compared to an arrangement in which the foregoing components are separately mounted, costs for manufacturing and mounting a driving circuit can be greatly reduced while improving reliability. Furthermore, since the foregoing components can readily be formed on a single substrate SUB, it is possible to reduce the number of manufacturing steps and the capacitance of each signal line. In addition, the use of the pre-charging circuit PC, the scanning signal line driving circuit GD and the data signal line driving circuit SD reduces a frame size due to reduction in a circuit scale, and power consumption.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image display device, comprising:

a plurality of pixels disposed in a matrix;

a display section, having a plurality of data signal lines for respective columns of the plurality of pixels and having a plurality of scanning signal lines corresponding to respective rows of the plurality of pixels, for displaying an image by writing a video signal from each data signal line into each pixel in synchronism with a scanning signal which is outputted from each scanning signal line;

a data signal line driving circuit for outputting the video signal to the plurality of data signal lines;

a scanning signal line driving circuit for outputting the scanning signal to the plurality of scanning signal lines;

a pre-charging circuit for writing a pre-charging voltage inputted in synchronism with a pre-charging control signal into the plurality of data signal lines in a predetermined period of time; and wherein a pre-charging voltage stabilizing section for stabilizing a pre-charging voltage and supplying the stabilized pre-charging voltage as said pre-charging voltage to the pre-charging circuit, so as to suppress fluctuation in said pre-charging voltage is provided on a preceding stage of said pre-charging circuit; and wherein said pre-charging voltage stabilizing section includes current controlling means composed of a resistor and charge holding means composed of a capacitance, where charge is supplied from the charge holding means when the pre-charging control signal is working and pre-charge voltage supplied from the control signal generating circuit is applied to the charge holding means while the precharging control signal is not working, and current controlling means is used.

2. The image display device as set forth in claim 1, wherein:

said charge holding means has a capacitance which is at least larger than a total capacitance of said plurality of data signal lines.

3. The image display device as set forth in claim 1, wherein:

when said pre-charging voltage is an AC voltage, time constants of said current controlling means and charge holding means making up said pre-charging voltage stabilizing section are shorter than a duration of time from switching of polarity of said pre-charging voltage to next activation of said pre-charge control signal.

4. The image display device as set forth in claim 1, wherein:

when said pre-charging voltage is an AC voltage, time constants of said current controlling means and charge holding means making up said pre-charging voltage stabilizing section are shorter than a duration of time from activation of said pre-charging control signal to next activation thereof.

5. The image display device as set forth in claim 1, wherein:

when said pre-charging voltage is an AC voltage, said current controlling means and charge holding means making up said pre-charging voltage stabilizing section are arranged to stabilize said pre-charging voltage to a sufficient potential within a period of said pre-charging control signal.

6. The image display device as set forth in claim 1, wherein:

when said pre-charging voltage is a DC voltage, said current controlling means and charge holding means making up said pre-charging voltage stabilizing section are arranged to sufficiently stabilize said pre-charging voltage during a period from feeding power to starting display.

7. The image display device as set forth in claim 1, wherein:

when said pre-charging voltage is a DC voltage, said current controlling means and charge holding means making up said pre-charging voltage stabilizing section are arranged to supply more charges than charges supplied to said data signal lines by said pre-charging voltage from said pre-charging circuit within a period of the pre-charging control signal.

8. A driving method of an image display device, said device comprising:

a plurality of pixels disposed in a matrix;

a display section, having a plurality of data signal lines for respective columns of the plurality of pixels and having a plurality of scanning signal lines corresponding to respective rows of the plurality of pixels, for displaying an image by writing a video signal from each data signal line into each pixel in synchronism with a scanning signal which is outputted from each scanning signal line;

a data signal line driving circuit for outputting said video signal to said plurality of data signal lines;

a scanning signal line driving circuit for outputting said scanning signal to said plurality of scanning signal lines;

a pre-charging circuit for writing a pre-charging voltage inputted in synchronism with a pre-charging control signal into the plurality of data signal lines in a predetermined period of time;

said driving method comprising the step of supplying said pre-charging voltage to a pre-charging voltage stabilizing section which is composed of current controlling means and charge holding means and is provided on a preceding stage of said pre-charging circuit, said pre-charging voltage having an AC voltage in synchronism with one horizontal period of said video signal; and wherein charge is supplied from the charge holding means when the pre-charging control signal is working and pre-charge voltage supplied from the control signal generating circuit is applied to the charge holding means while the pre-charging control signal is not working, and current controlling means is used.

9. The driving method of the image display device as set forth in claim 8, wherein:

said pre-charging voltage has a polarity opposite to that of said video signal.

10. The driving method of the image display device as set forth in claim 8, wherein:

said pre-charging voltage has an AC voltage which is equipotential from maximum amplification values of positive and negative polarities of said video signal.

11. A driving method of an image display device, said device comprising:

a plurality of pixels disposed in a matrix;

a display section, having a plurality of data signal lines for respective columns of the plurality of pixels and having a plurality of scanning signal lines corresponding to respective rows of the plurality of pixels, for displaying an image by writing a video signal from each data signal line into each pixel in synchronism with a scanning signal which is outputted from each scanning signal line;

a data signal line driving circuit for outputting said video signal to said plurality of data signal lines;

a scanning signal line driving circuit for outputting said scanning signal to said plurality of scanning signal lines; and a pre-charging circuit for writing a pre-charging voltage inputted in synchronism with a pre-charging control signal into the plurality of data signal lines in a predetermined period of time; and said driving method comprising the step of supplying said pre-charging voltage to a pre-charging voltage stabilizing section which is composed of current controlling means and charge holding means and is provided on a preceding stage of said pre-charging circuit, said pre-charging voltage having a DC voltage in synchronism with one horizontal period of said video signal, wherein charge is supplied from the charge holding means when the pre-charging control signal is working and pre-charge voltage supplied from the control signal generating circuit is applied to the charge holding means while the pre-charging control signal is not working, and current controlling means is used.

12. The driving method of the image display device as set forth in claim 11, wherein:

said pre-charging voltage has a DC voltage which is equipotential from maximum amplification values of positive and negative polarities of said video signal.

13. An image display device which displays an image by writing a video signal with respect to a plurality of pixels disposed in a matrix via a plurality of data signal lines, comprising:

a pre-charging circuit for writing a pre-charging voltage inputted in synchronism with a pre-charging control signal into the plurality of data signal lines in a predetermined period of time before said video signal is written into said data signal lines;

a pre-charging voltage stabilizing circuit for stabilizing said pre-charging voltage so as to supply charges to said pre-charging circuit by said pre-charging voltage, the charges being not less than an amount of charges which was supplied to said data signal lines by said pre-charging circuit; and wherein said pre-charging voltage stabilizing circuit includes current controlling means composed of a resistor and charge holding means composed of a capacitance, where charge is supplied from the charge holding means when the pre-charging control signal is working and pre-charge voltage supplied from the control signal generating circuit is applied to the charge holding means while the pre-charging control signal is not working, and current controlling means is used.

14. The image display device as set forth in claim 13, wherein:

when said pre-charging voltage is an AC voltage, time constants according to said resistor and capacitor are shorter than a duration of time from switching of polarity of said pre-charging voltage to next activation of said pre-charging control signal.

15. The image display device as set forth in claim 13, wherein:

when said pre-charging voltage is an AC voltage, time constants according to said resistor and capacitor are shorter than a duration of time from activation of said pre-charging control signal to next activation thereof.

16. The image display device as set forth in claim 13, wherein:

when said pre-charging voltage is a DC voltage, time constants according to said resistor and capacitor provide time sufficient to stabilize said pre-charging voltage during a period from feeding power to starting said display.

17. A driving method of an image display device, said device comprising:

a plurality of pixels disposed in a matrix;

a display section, having a plurality of data signal lines for respective columns of the plurality of pixels and having a plurality of scanning signal lines corresponding to respective rows of the plurality of pixels, for displaying an image by supplying a video signal from each data signal line to each pixel in correspondence with a scanning signal which is supplied from each scanning signal line;

a data signal line driving circuit for outputting a video signal to the plurality of data signal lines in synchronism with a predetermined timing signal;

a scanning signal line driving circuit for outputting a scanning signal to the plurality of scanning signal lines by a pulse width control signal which controls an output signal in synchronism with a scanning start signal and a scanning timing signal, and a signal width of the output signal;

a pre-charging circuit for writing a pre-charging voltage inputted in synchronism with a pre-charging control signal into the plurality of data signal lines in a predetermined period of time;

pre-charging voltage stabilizing means for stabilizing a pre-charging voltage from the pre-charging circuit; and a control signal generating circuit for supplying the circuits with a control signal so as to control operations thereof, said driving method comprising the step of suspending a scanning signal for a predetermined period of time when a pre-charging voltage stabilizing circuit having charge holding means and current controlling means as the pre-charging voltage stabilizing means is used to perform display at fixed brightness in first and second display areas which are respectively provided corresponding to a first portion and/or a second portion on a screen of the display section by a pre-charging voltage inputted from the pre-charging circuit, wherein charge is supplied from the charge holding means when the pre-charging control signal is working and pre-charge voltage supplied from the control signal generating circuit is applied to the charge holding means while the pre-charging control signal is not working, and current controlling means is used.

18. The driving method of the image display device as set forth in claim 17, wherein:

input of the scanning signal start signal to the scanning signal line driving circuit is suspended for a predetermined period of time so as to suspend the scanning signal.

19. The driving method of the image display device as set forth in claim 17, wherein:

input of the scanning start signal and the scanning timing signal to the scanning signal line driving circuit is suspended for the predetermined period of time so as to suspend the scanning signal.

20. The driving method of the image display device as set forth in claim 17, wherein input of the scanning timing signal to the scanning signal line driving circuit and the pulse width control signal are suspended for the predetermined period of time so as to suspend the scanning signal.

21. The driving method of the image display device as set forth in claim 17, wherein:

the predetermined period of time is not less than a time constant of current controlling means and charge holding means which form the pre-charging voltage stabilizing circuit.

22. The driving method of the image display device as set forth in claim 18, wherein:

the predetermined period of time is not less than a time constant of current controlling means and charge holding means which form the pre-charging voltage stabilizing circuit.

23. The driving method of the image display device as set forth in claim 19, wherein:

the predetermined period of time is not less than a time constant of current controlling means and charge holding means which form the pre-charging voltage stabilizing circuit.

24. The driving method of the image display device as set forth in claim 20, wherein:

the predetermined period of time is not less than a time constant of current controlling means and charge holding means which form the pre-charging voltage stabilizing circuit.

25. The driving method of the image display device as set forth in claim 17, wherein:

the predetermined period of time is not less than time required for sufficiently stabilizing the pre-charging voltage.

26. The driving method of the image display device as set forth in claim 18, wherein:

the predetermined period of time is not less than time required for sufficiently stabilizing the pre-charging voltage.

27. The driving method of the image display device as set forth in claim 19, wherein:

the predetermined period of time is not less than time required for sufficiently stabilizing the pre-charging voltage.

28. The driving method of the image display device as set forth in claim 20, wherein:

the predetermined period of time is not less than time required for sufficiently stabilizing the pre-charging voltage.

29. The driving method of the image display device as set forth in claim 21, wherein:

the predetermined period of time is not less than time required for sufficiently stabilizing the pre-charging voltage.

30. The driving method of the image display device as set forth in claim 22, wherein:

the predetermined period of time is not less than time required for sufficiently stabilizing the pre-charging voltage.

31. The driving method of the image display device as set forth in claim 23, wherein:

the predetermined period of time is not less than time required for sufficiently stabilizing the pre-charging voltage.

32. The driving method of the image display device as set forth in claim 24, wherein:

the predetermined period of time is not less than time required for sufficiently stabilizing the pre-charging voltage.

33. An image display device, comprising:

a plurality of pixels disposed in a matrix;

a display section, having a plurality of data signal lines for respective columns of the plurality of pixels and having a plurality of scanning signal lines corresponding to respective rows of the plurality of pixels, for displaying an image by supplying a video signal from each data signal line to each pixel in correspondence with a scanning signal which is supplied from each scanning signal line;

a data signal line driving circuit for outputting a video signal to the plurality of data signal lines in synchronism with a predetermined timing signal;

a scanning signal line driving circuit for outputting a scanning signal to the plurality of scanning signal lines by a pulse width control signal which controls an output signal in synchronism with a scanning start signal and a scanning timing signal, and a signal width of the output signal;

a pre-charging circuit for writing a pre-charging voltage inputted in synchronism with a pre-charging control signal into the plurality of data signal lines in a predetermined period of time;

pre-charging voltage stabilizing means for stabilizing a pre-charging voltage from the pre-charging circuit; and a control signal generating circuit for supplying the circuits with a control signal so as to control operations thereof, wherein:

the pre-charging voltage stabilizing means includes a pre-charging voltage stabilizing circuit having charge holding means and current controlling means, where charge is supplied from the charge holding means when the pre-charging control signal is working and pre-charge voltage supplied from the control signal generating circuit is applied to the charge holding means while the pre-charging control signal is not working, and current controlling means is used, and in a non-match image display mode, one portion of the display section is set as a video data non-display area which avoids display of video data, said image display device, further comprising:

a control signal generating section for suspending a scanning signal for a predetermined period of time is provided in the control signal generating circuit, when performing display at fixed brightness in the video data non-display area by a pre-charging voltage inputted from the pre-charging circuit.

34. The image display device as set forth in claim 33, wherein the predetermined period of time is not less than a time constant of current controlling means and charge holding means which form the pre-charging voltage stabilizing circuit.

35. The image display device as set forth in claim 33, wherein the pre-charging circuit, the data signal line driving circuit, the scanning signal line driving circuit and the pixels are formed on a single substrate.

36. The image display device as set forth in claim 34, wherein the pre-charging circuit, the data signal line driving circuit, the scanning signal line driving circuit and the pixels are formed on a single substrate.

37. The image display device as set forth in claim 33, wherein a switching element composing the pre-charging circuit, the data signal line driving circuit, the scanning signal line driving circuit and the pixels is made of a polycrystalline silicon thin film transistor.

38. The image display device as set forth in claim 34, wherein a switching element composing the pre-charging circuit, the data signal line driving circuit, the scanning signal line driving circuit and the pixels is made of a polycrystalline silicon thin film transistor.

39. The image display device as set forth in claim 35, wherein a switching element composing the pre-charging circuit, the data signal line driving circuit, the scanning signal line driving circuit and the pixels is made of a polycrystalline silicon thin film transistor.

40. The image display device as set forth in claim 36, wherein a switching element composing the pre-charging circuit, the data signal line driving circuit, the scanning signal line driving circuit and the pixels is made of a polycrystalline silicon thin film transistor.

41. The image display device as set forth in claim 33, wherein switching elements which respectively form the pre-charging circuit, the data signal line driving circuit, the scanning signal line driving circuit and the pixels are manufactured at a process temperature of not more than 600° C.

42. The image display device as set forth in claim 34, wherein switching elements which respectively form the pre-charging circuit, the data signal line driving circuit, the scanning signal line driving circuit and the pixels are manufactured at a process temperature of not more than 600° C.

43. The image display device as set forth in claim 35, wherein switching elements which respectively form the pre-charging circuit, the data signal line driving circuit, the scanning signal line driving circuit and the pixels are manufactured at a process temperature of not more than 600° C.

44. The image display device as set forth in claim 36, wherein switching elements which respectively form the pre-charging circuit, the data signal line driving circuit, the scanning signal line driving circuit and the pixels are manufactured at a process temperature of not more than 600° C.

45. The image display device as set forth in claim 37, wherein switching elements which respectively form the pre-charging circuit, the data signal line driving circuit, the scanning signal line driving circuit and the pixels are manufactured at a process temperature of not more than 600° C.

46. The image display device as set forth in claim 38, wherein switching elements which respectively form the pre-charging circuit, the data signal line driving circuit, the scanning signal line driving circuit and the pixels are manufactured at a process temperature of not more than 600° C.

47. The image display device as set forth in claim 39, wherein switching elements which respectively form the pre-charging circuit, the data signal line driving circuit, the scanning signal line driving circuit and the pixels are manufactured at a process temperature of not more than 600° C.

48. The image display device as set forth in claim 40, wherein switching elements which respectively form the pre-charging circuit, the data signal line driving circuit, the scanning signal line driving circuit and the pixels are manufactured at a process temperature of not more than 600° C.

* * * * *